US008818546B2

(12) United States Patent
Kato

(10) Patent No.: US 8,818,546 B2
(45) Date of Patent: Aug. 26, 2014

(54) MULTI-NEEDLE SEWING MACHINE AND COMPUTER-READABLE STORAGE MEDIUM STORING EMBROIDERY DATA PROCESSING PROGRAM

(75) Inventor: Harumi Kato, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 57 days.

(21) Appl. No.: 13/560,718

(22) Filed: Jul. 27, 2012

(65) Prior Publication Data

US 2013/0036957 A1 Feb. 14, 2013

(30) Foreign Application Priority Data

Aug. 9, 2011 (JP) ..... 2011-173848

(51) Int. Cl.

| | |
|---|---|
| ***D05C 5/02*** | (2006.01) |
| ***D05C 5/04*** | (2006.01) |
| ***D05B 19/12*** | (2006.01) |
| ***D05B 19/10*** | (2006.01) |

(52) U.S. Cl.

CPC *D05B 19/12* (2013.01); *D05C 5/04* (2013.01); *D05B 19/10* (2013.01)

USPC ..... 700/138; 112/470.01; 112/470.04

(58) Field of Classification Search

USPC ..... 112/470.01, 470.04, 470.06, 475.18, 112/475.19; 700/136–138

See application file for complete search history.

(56) References Cited

U.S. PATENT DOCUMENTS

| | | | | |
|---|---|---|---|---|
| 4,869,188 | A | 9/1989 | Hyodo | |
| 6,012,402 | A * | 1/2000 | Sekine | 112/470.04 |
| 6,304,793 | B1 | 10/2001 | Komiya et al. | |

(Continued)

FOREIGN PATENT DOCUMENTS

| | | |
|---|---|---|
| JP | A-1-139855 | 6/1989 |
| JP | A-11-57262 | 3/1999 |

(Continued)

OTHER PUBLICATIONS

Rasekaidan, User's Guide and Overview of Electric Quilt 6 Software including "Concise Explanation of Relevance for Lesson 2 of The User's Guide to Electric Quilt Software 6"retreived on Oct. 18, 2010, by same assignor within co-pending U.S. Appl. No. 13/361,401, 21 pages.*

U.S. Appl. No. 13/361,401, filed Jan. 30, 2012 in the name of Maki et al.

*Primary Examiner* — Nathan Durham

(74) *Attorney, Agent, or Firm* — Oliff PLC

(57) ABSTRACT

A multi-needle sewing machine includes an assigning unit that assigns thread color data to each pattern-by-color portion. The assigning unit is configured to determine, for each pattern-by-color portion, whether or not the user's designation of the pattern-by-color portion has been received. When the user's designation for the pattern-by-color portion has been received, the assigning unit is configured to assign the user's designation as thread color data for the pattern-by-color portion. When the user's designation for the pattern-by-color portion has not been received, the assigning unit is configured to randomly extract and assign a non-overlapping color as thread color data for the pattern-by-color portion from the data of a plurality of thread colors stored in the spool color storage unit. The machine is configured to execute sewing of the embroidery pattern for the pattern-by-color portion based on the thread color data assigned by the assigning unit.

12 Claims, 17 Drawing Sheets

(56) References Cited

U.S. PATENT DOCUMENTS

| | | | | |
|---|---|---|---|---|
| 6,980,877 | B1 * | 12/2005 | Hagino et al. | 700/138 |
| 7,228,195 | B2 * | 6/2007 | Hagino | 700/138 |
| 2005/0188906 | A1 | 9/2005 | Goto et al. | |
| 2006/0060115 | A1 | 3/2006 | Hagino | |
| 2008/0223274 | A1 | 9/2008 | Okuyama | |

FOREIGN PATENT DOCUMENTS

| | | |
|---|---|---|
| JP | A-2005-95367 | 4/2005 |
| JP | A-2005-218705 | 8/2005 |
| JP | A-2006-87502 | 4/2006 |
| JP | A-2008-220615 | 9/2008 |

* cited by examiner

| EMBROIDERY DATA | |
|---|---|
| FIRST PATTERN PORTION DATA | PATTERN 1 PURPLE |
| | Xa0,Ya0 |
| | Xa1,Ya1 |
| | Xa2,Ya2 |
| | ⋮ |
| | XaN,YaN |
| SECOND PATTERN PORTION DATA | PATTERN 2 ROSE |
| | Xb0,Yb0 |
| | Xb1,Yb1 |
| | Xb2,Yb2 |
| | ⋮ |
| | XbN,YbN |
| THIRD PATTERN PORTION DATA | PATTERN 3 MAGENTA |
| | Xc0,Yc0 |
| | Xc1,Yc1 |
| | Xc2,Yc2 |
| | ⋮ |
| | XcN,YcN |
| ⋮ | ⋮ |
| n-TH PATTERN PORTION DATA | PATTERN n RED |
| | Xn0,Yn0 |
| | Xn1,Yn1 |
| | Xn2,Yn2 |
| | ⋮ |
| | XnN,YnN |

FIG. 4

| NEEDLE BAR NO. | THREAD COLOR |
|---|---|
| 1 | PURPLE |
| 2 | ROSE |
| 3 | MAGENTA |
| 4 | GREEN |
| 5 | PURPLE |
| 6 | WHITE |
| ⋮ | ⋮ |
| 10 | RED |

FIG. 5

MULTI-NEEDLE SEWING MACHINE AND COMPUTER-READABLE STORAGE MEDIUM STORING EMBROIDERY DATA PROCESSING PROGRAM

CROSS-REFERENCE TO RELATED APPLICATIONS

This application is based upon and claims the benefit of priority from the prior Japanese Patent Application No. 2011-173848 filed on Aug. 9, 2011, the entire contents of which are incorporated herein by reference.

BACKGROUND

1. Technical Field

The present disclosure relates to a multi-needle sewing machine which executes a sewing operation based on embroidery data for sewing an embroidery pattern composed of a plurality of pattern-by-color portions, using a plurality of thread spools set on a thread spool stand, and the disclosure also relates to a computer-readable storage medium storing an embroidery data processing program.

2. Related Art

There have conventionally been known multi-needle sewing machines which sew an embroidery pattern based on embroidery data. One of the multi-needle sewing machines is provided with a plurality of needle bars to which needles are attached respectively. Different colors of needle threads are supplied to the respective needles of the needle bars. A plurality of embroidery patterns is stored on a storage device built in the multi-needle sewing machine or on an external storage device such as a ROM card or a flexible disc. When a user selects a desirable one of the plural embroidery patterns, the multi-needle sewing machine reads embroidery data of the selected embroidery pattern to sew the embroidery pattern on a workpiece cloth while transferring an embroidery frame holding the cloth by a transfer mechanism.

An embroidery pattern normally includes a plurality of pattern-by-color portions. More specifically, embroidery data of an embroidery pattern includes thread color data for identifying colors of pattern-by-color portions. One of the needle bars is selected and the selected needle bar is moved to a sewing position so that each pattern-by-color portion is sewn in a set color (thread color). In this case, when the color of each pattern-by-color portion is similar to a color of the workpiece cloth (fabric) on which the embroidery pattern is to be sewn, there would occur a problem that each pattern-by-color portion is difficult to distinguish from the workpiece cloth. More specifically, when an embroidery pattern of "flower" is sewn on a workpiece cloth that has the same color as a color of pattern-by-color portion of flower petal, the flower petal and the workpiece cloth are difficult to distinguish each from the other, whereupon there is a possibility that the embroidery pattern may mistakenly be regarded as an odd flower without flower petal.

In view of the above-described problem, the conventional art provides an embroidery data generating device which stores coloration data indicative of preferable combinations of colors, so that colors of thread color data of pattern-by-color portions are set on the basis of cloth data indicative of the coloration data, color of the workpiece cloth and the like.

The aforementioned conventional embroidery data generating device unmistakably determines colors of pattern-by-color portions of an embroidery pattern based on the color of the workpiece cloth and coloration data. However, the user would sometimes sew each pattern-by-color portion in a preferable color or an odd color but not using a previously set color. Furthermore, in order that such designation of colors of an embroidery pattern may be carried out, data of each pattern-by-color portion needs to be read one by one to confirm and designate thread color data, with the result that the embroidery sewing is troublesome.

SUMMARY

Therefore, an object of the disclosure is to provide a multi-needle sewing machine which can easily carry out coloration of the embroidery pattern using a thread spool set thereon and can sew embroidery patterns with a variety of coloration patterns, and a computer-readable storage medium storing an embroidery data processing program for the multi-needle sewing machine.

The disclosure provides a multi-needle sewing machine which sews an embroidery pattern based on embroidery data for sewing the embroidery pattern including a plurality of pattern-by-color portions, using a plurality of thread spools, the multi-needle sewing machine comprising a spool setting portion on which the thread spools are set, a spool color storage unit which stores, as thread spool color data, a plurality of thread colors of the thread spools set on the thread spool stand, an input unit configured to receive one or more user's designations of color for one or more pattern-by-color portions, an assigning unit that assigns thread color data to each pattern-by-color portion, the assigning unit being configured to determine, for each pattern-by-color portion, whether or not the user's designation of the pattern-by-color portion has been received, when the user's designation for the pattern-by-color portion has been received, assign the user's designation as thread color data for the pattern-by-color portion, and when the user's designation for the pattern-by-color portion has not been received, then randomly extract and assign a non-overlapping color as thread color data for the pattern-by-color portion from the data of the plurality of thread colors stored in the spool color storage unit, wherein the multi-needle sewing machine is configured to execute sewing of the embroidery pattern for the pattern-by-color portion based on the thread color data assigned by the assigning unit.

BRIEF DESCRIPTION OF THE DRAWINGS

In the accompanying drawings:

FIG. 4 exemplifies embroidery data;

FIG. 5 exemplifies a needle-bar thread color table;

DETAILED DESCRIPTION

Figure 1:
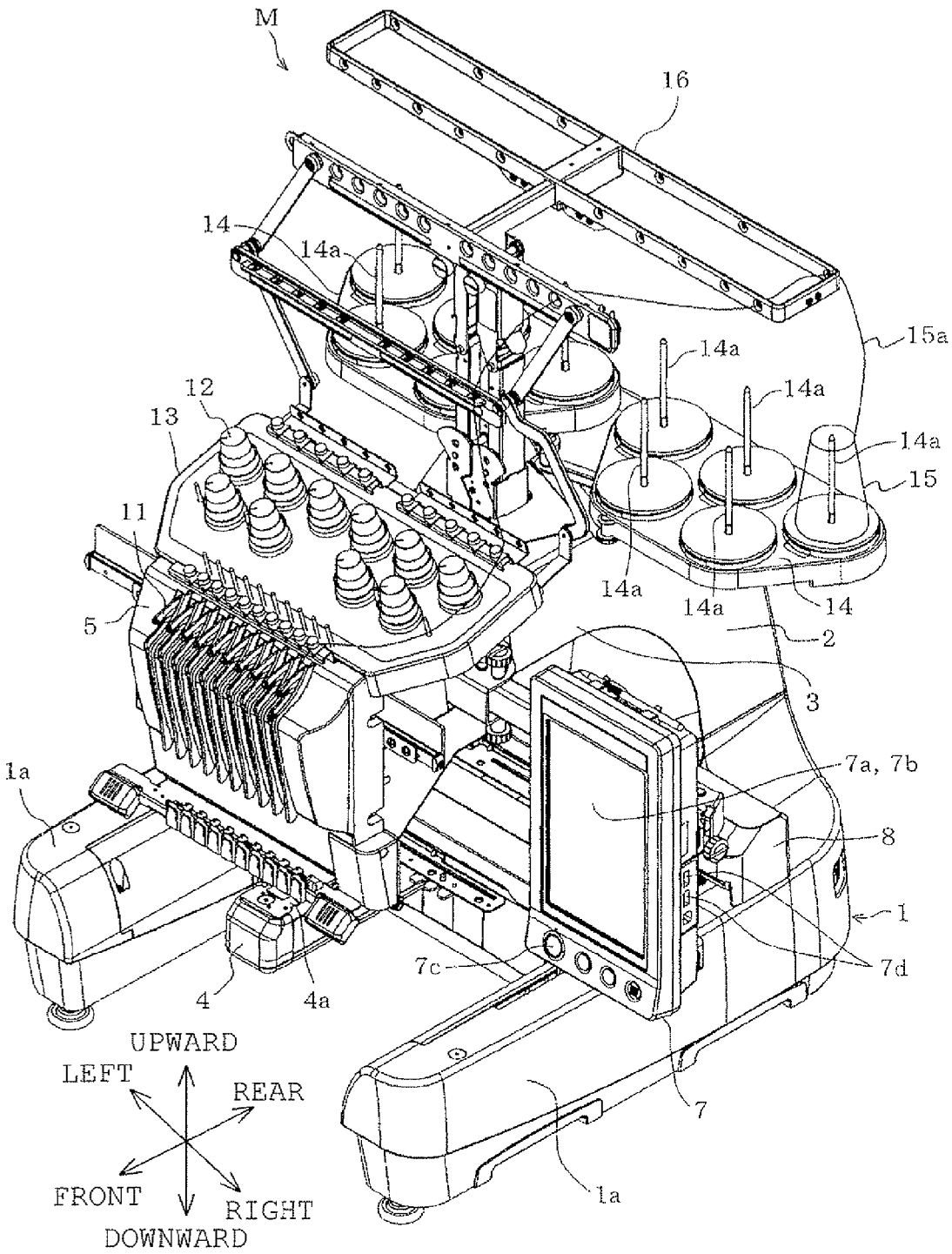
FIG. 1 is an overall perspective view of the multi-needle sewing machine in accordance with a first example.

A first example of multi-needle sewing machine (hereinafter, "sewing machine M") will be described with reference to FIGS. 1 to 15. Referring to FIG. 1, the side where the user is located relative to the sewing machine M will be referred to as "front" and the side opposed to the front will be referred to as "rear." A right obliquely downward direction on FIG. 1 will be referred to as "right" and the direction opposite the right will be referred to as "left" with respect to the sewing machine M. A vertically upward direction on FIG. 1 will be referred to as "upward" and the direction opposite the upward direction will be referred to as "downward" with respect to the sewing machine M.

The sewing machine M includes a support leg 1 supporting the entire sewing machine, a pillar 2 standing from a rear end of the support leg 1, an arm 3 extending frontward from an upper part of the pillar 2 and a needle-bar case 5 attached to a front end of the arm 3, as shown in FIG. 1. The sewing machine M further includes a control device 6 (see FIG. 2) and an operation panel 7. The support leg 1 has right and left leg portions la extending frontward and is formed into a generally U-shape with an open front as viewed from above. A cylinder bed 4 extending frontward is provided on a central rear of the support leg 1. The cylinder bed 4 has an upper surface provided with a needle plate 4*a*. The needle plate 4*a* has a needle hole (not shown) serving as a needle location of a needle 11 as will be described later.

A carriage 8 is disposed on the upper side of the support leg 1 so as to extend in the right-left direction. The carriage 8 houses an X-direction drive mechanism 9*x* (see FIG. 2) which drives a frame mount (not shown) provided at the front side of the carriage 8, in the right-left or X direction. The leg portions la house a Y-direction drive mechanism 9*y* (see FIG. 2) which drives the carriage 8 in the front-rear or Y direction. An X-axis motor 30 and a Y-axis motor 31 serve as drive sources for the X-direction and Y-direction drive mechanisms 9*x* and 9*y* respectively. A workpiece cloth on which an embroidery pattern is to be sewn is held on a generally rectangular embroidery frame although neither shown. Thus, the embroidery frame is moved together with the carriage 8 in the X direction or together with the frame mount by the X-direction and Y-direction drive mechanisms 9*x* and 9*y*, whereby the workpiece cloth is fed for sewing purposes. The workpiece cloth is moved with movement of the embroidery frame in the X and Y directions.

Ten needle bars 10 (as shown in only FIG. 2) are supported in the needle-bar case 5 so as to be arranged in a right-left direction and so as to vertically extend. The needle bars 10 are movable upward and downward. The needle bars 10 have lower ends to which sewing needles (not shown) are attached respectively. The needle bars 10 are assigned with needle bar numbers 1 to 10 sequentially from the right one as viewed at the front of the sewing machine M. An inclined thread tension bracket 13 is fixed to an upper end of the needle bar case 5. Ten thread tension completes 12 are mounted on the thread tension bracket 13 for adjustment of thread tensions. A pair of right and left spool holder bases 14 and a thread guide mechanism 16 are provided in the rear of the thread tension bracket 13 so as to be located above the rear side of the arm 3. The thread guide mechanism 16 prevents the thread from being entangled. The spool holder bases 14 serve as a spool setting portion.

Further referring to FIG. 1, each spool holder base 14 is formed into a substantially trapezoidal shape as viewed on a planar view. Each spool holder base 14 has five spool pins 14*a* to which thread spools 15 are to be fitted respectively. More specifically, ten thread spools 15 the number of which is the same as that of the needles can be set on the paired spool holder bases 14. Only one of the thread spools 15 is shown in FIG. 1 for the sake of ease of explanation. Needle threads drawn from the respective thread spools 15 are supplied through the aforementioned thread guide mechanism 16, thread tension completes 12, thread take-up levers 11 and the like to be inserted through respective needle eyes (not shown).

A needle bar selecting mechanism 20 (see FIG. 2) is provided in the arm 3 for moving the needle-bar case 5 in the X direction. The needle bar selecting mechanism 20 is driven by a drive motor (not shown) to selectively switch one of ten groups of the needle bars 10 and the thread take-up levers 11 to the needle location. The switched needle bar 10 and thread take-up lever 11 are vertically moved at the needle location in a synchronous manner by a needle-bar drive mechanism 22 (see FIG. 2). The needle-bar drive mechanism 22 is driven by transmitting rotation of a sewing machine motor 21 (see FIG. 2) provided in the pillar 2 via a main shaft (not shown) thereto. Furthermore, on the front end of the cylinder bed 4 are mounted a rotary hook (not shown) accommodating a bobbin on which a bobbin thread (not shown) is wound and a cutting mechanism 19 (see FIG. 2) which cuts the needle thread 18 and the bobbin thread.

Stitches comprising the needle thread 15*a* and bobbin thread are formed on the workpiece cloth held by the embroidery frame by cooperation between the needle bar 10 and the thread take-up lever 11, and the rotary hook. In this case, the embroidery frame is transferred in the X and Y directions on the basis of embroidery pattern data which will be described later, whereby an embroidery pattern is sewn on the workpiece cloth.

The operation panel 7 serving as an informing unit is mounted on a right side of the arm 3 so as to be foldable. The operation panel 7 includes an oblong liquid crystal color display 7*a* (hereinafter, "display 7*a*") which can perform full-color display. The display 7*a* displays various embroidery patterns and function names which cause the sewing machine to execute various functions necessary for the sewing operation. The display 7*a* further displays information about the needle thread 15*a* which is set so as to correspond to the needle bar 10, a setting screen on which colors of embroidery patterns are set as will be described later, and the like (see FIG. 6). A touch panel 7*b* (see FIG. 2) is mounted on a front of the display 7*a* and has a plurality of touch keys each comprising a transparent electrode. When the touch keys are depressed by user's finger or a touch pen (not shown), the sewing machine can execute selection of an embroidery pattern, setting of various parameters, instruction of functions, setting at the time of replacement of thread spools 15 as will be described later, and the like.

A plurality of switches including a start/stop switch 7*c* is provided on a lower front of the operation panel 7. The operation panel 7 includes a connector 7*d* which is mounted in one side thereof and to which an external storage medium such as a USB memory (not shown) is connected.

Figure 2:
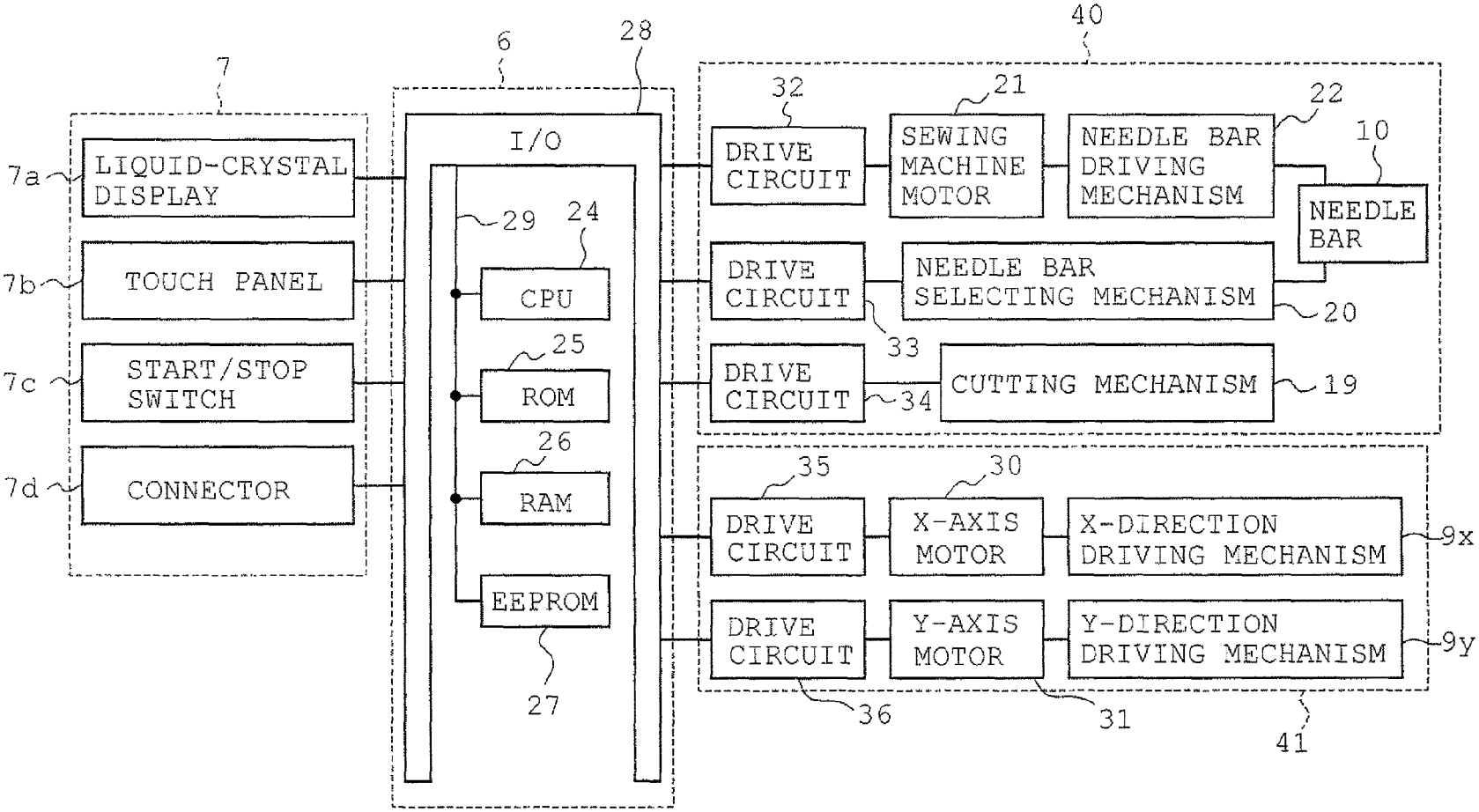
FIG. 2 is a block diagram showing an electrical arrangement of the machine.

An electrical arrangement of the control system of the sewing machine M will now be described with reference to the block diagram of FIG. 2. The control device 6 is mainly configured by a microcomputer and incorporates a CPU 24, a ROM 25, a RAM 26, an EEPROM 27, an input/output (I/O) interface 28, buses 29 connecting these devices 24-27 to the I/O interface 28, and the like. To the I/O interface 28 are connected the display 7*a*, the touch panel 7*b*, the start/stop switch 7*c* and the connector 7*d*. To the I/O interface 28 are also connected drive circuits 32 to 36 driving the sewing machine motor 21, the needle bar selecting mechanism 20, the cutting mechanism 19, the X-axis motor 30 and the Y-axis motor 31 respectively.

In the sewing machine M, a sewing unit 40 is constituted by the needle bars 10, a needle, a rotary hook, the sewing machine motor 21, the needle-bar drive mechanism 22, the needle-bar selecting mechanism 20, the cutting mechanism 19, the drive circuits 32 to 34 and the like. A transfer unit 41 is constituted by the Y-direction drive mechanism 9*y* transferring the embroidery frame holding the workpiece cloth, the X-direction drive mechanism 9*x*, the X-axis motor 30, the Y-axis motor 31, the drive circuits 35 and 36 and the like. The control device 6 controls the above-described actuators in accordance with a sewing control program, embroidery pattern data and the like as will be described later. Thus, a sequence of sewing operation for the workpiece cloth is executed by cooperation between the sewing unit 40 and the transfer unit 41.

The ROM 25 serving as an embroidery data storage unit stores embroidery data, a sewing control program and a full thread information table about a plurality of types of threads used for embroidery sewing, inclusive of information about thread color, part number and the like. The ROM 25 stores an embroidery data processing program, a thread designation control program on the user correlates thread color data of the needle thread 15*a* supplied from the thread spool 15 to the needle bar 10, and a display control program on which the display 7*a* of the operation panel 7 is controlled. These programs and data may be stored by another inner storage unit such as EEPROM 27 or the like or by an external storage unit such as the USB memory.

Figure 3:
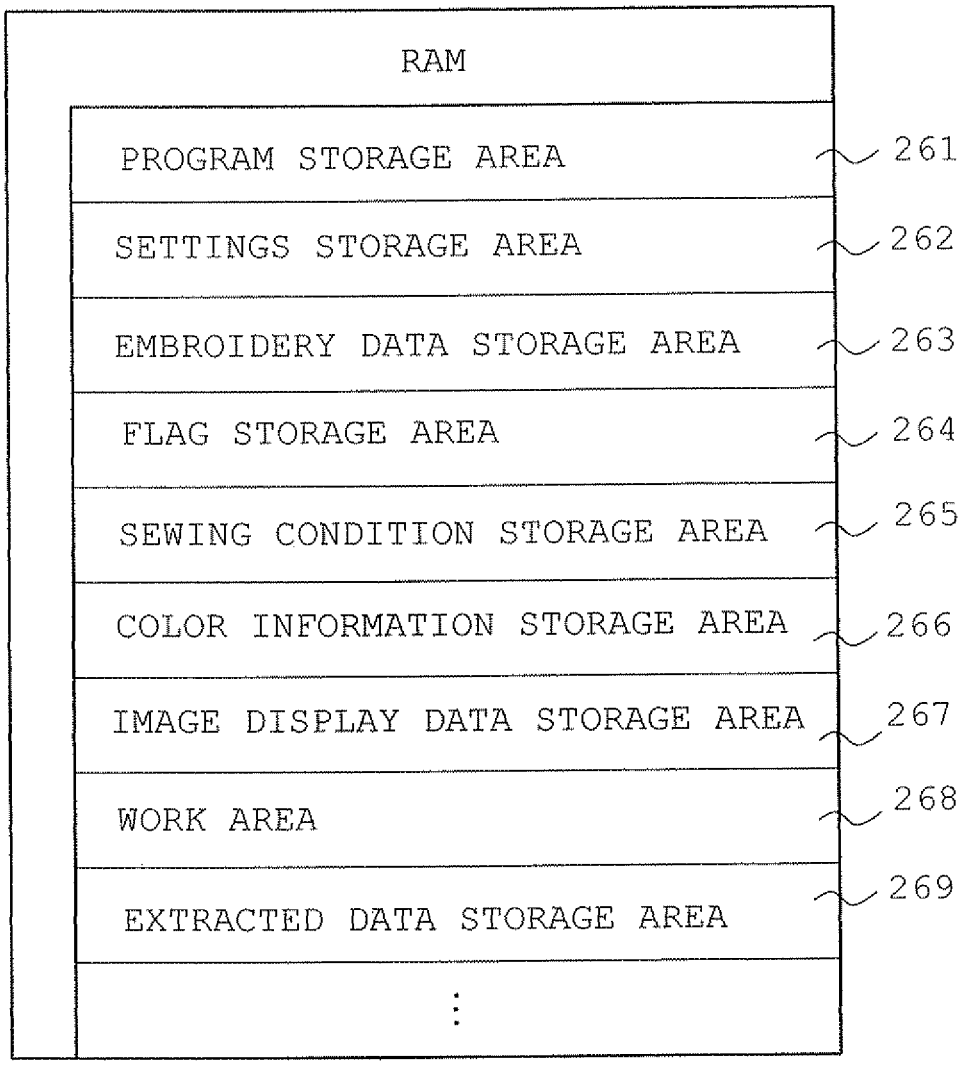
FIG. 3 schematically shows storage areas of a RAM of the machine.

The RAM 26 is provided with a memory which temporarily stores the abovementioned programs and data, various settings input on the touch panel 7*b*, results of operation carried out by the control device 6, etc. More specifically, as shown in FIG. 3, the RAM 26 is provided with a plurality of storage areas including a program storage area 261, a setting storage area 262, an embroidery data storage area 263, a flag storage area 264, a sewing condition storage area 265, a color information storage area 266, an image display data storage area 267, a work area 268 and an extracted data storage area 269. The program storage area 261 stores various programs read from the ROM 25 and the like. The setting storage area 262 stores set values, tables and the like which are referred to in execution of programs. The embroidery data storage area 263 stores original (reference) data in setting the color of the embroidery data. The flag storage area 264 stores various flags used in execution of programs. The sewing condition storage area 265 stores various sewing conditions in sewing an embroidery pattern.

The color information storage area 266 stores data used for coloration of an embroidery pattern, thus storing a pallet table, a needle bar thread color table and the like. Furthermore, the extracted data storage area 269 primarily stores a color extracted from the pallet table or the like in a random manner. The image display data storage area 267 stores image data of a screen to be displayed on the display 7*a* and display settings, and the work area 268 preliminarily stores set values used in execution of various programs.

Figure 11:
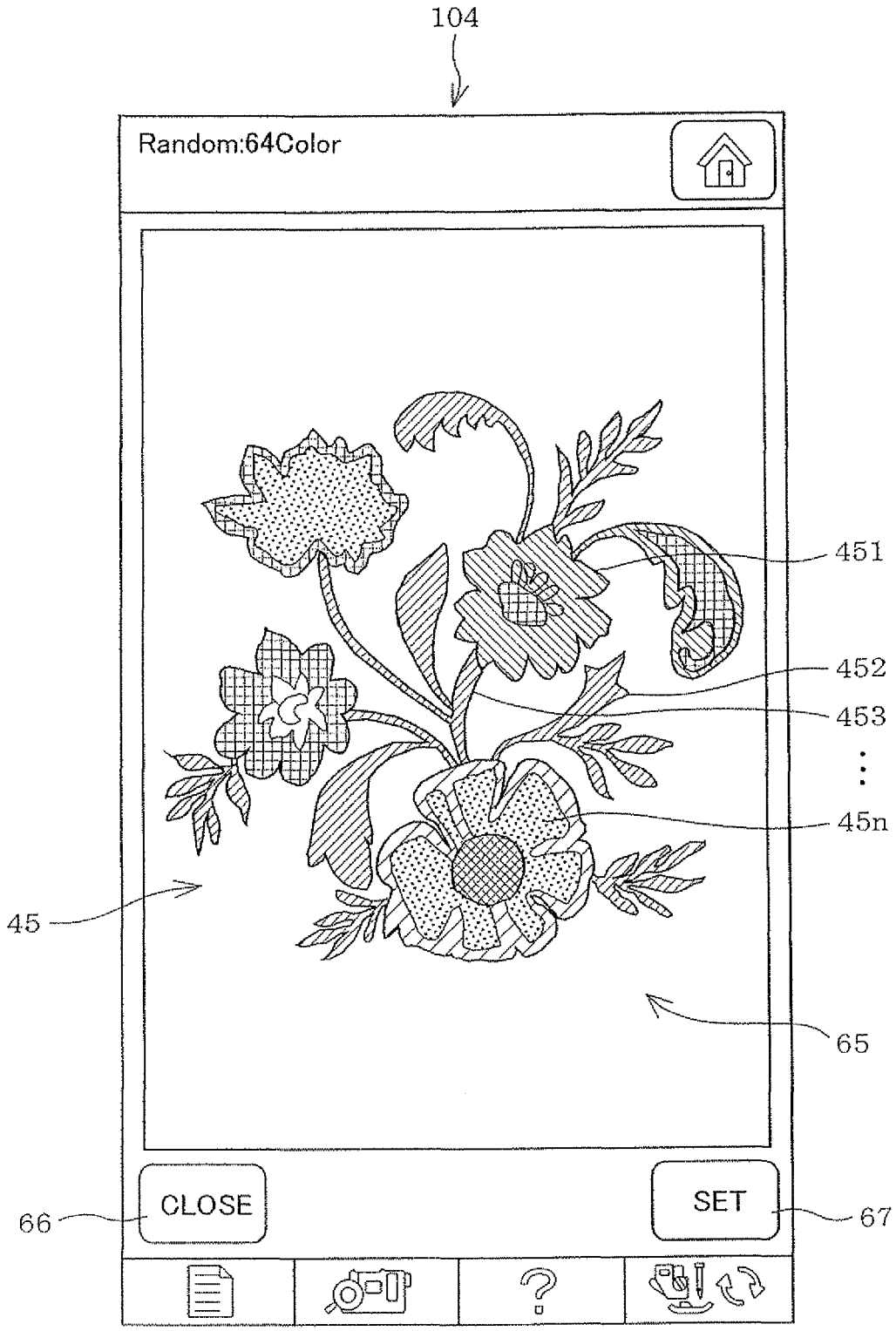
FIG. 11 exemplifies an enlarged display screen.

An embroidery pattern 45 of "flower" displayed on a screen 104 of the display 7*a* as shown in FIG. 11 will be described as an example of the embroidery pattern. The embroidery pattern 45 includes a first pattern part 451 to an n-th pattern part 45*n* serving as a plurality of (n-number of) pattern-by-color portions. More specifically, for example, the first pattern part 451 composing a flower petal is sewn using a purple thread. The second pattern part 452 composing a leaf is sewn using a rose color thread. The third pattern part 453 composing a stalk is sewn using a magenta thread. Thus, although the pattern-by-color portions 451 to 45*n* are set on the basis of colors, the pattern-by-color portions may not be colored differently from one another.

Embroidery data is used to sew an embroidery pattern by the sewing machine M and comprises data of a plurality of pattern-by-color portions. For example, the embroidery data of embroidery pattern 45 includes data of a plurality of needle locations set for every one of pattern-by-color portions 451 to 45*n*, data of sewing sequence for specifying a sewing sequence of pattern-by-color portions 451 to 45*n* (pattern 1 to pattern n), and thread color data, as shown in FIG. 4. The thread color data is provided for specifying for every pattern part by color, and colors are allotted from color information by an allotting unit as will be described later.

Sewing sequence data "pattern 1" on the top of FIG. 4 specifies an initial sewing, and "purple" corresponding to "pattern 1" is actually thread color data shown by RGB values, for example. Furthermore, needle location data "XaO, YaO" . . . "XaN, YaN" indicates coordinates of needle locations of a needle corresponding to the thread color of "purple". In the same manner, embroidery data for second and subsequent sewing also include sewing sequence data "pattern 2" to "pattern n," thread color data "rose color" to "red" and needle location data "XbN, YbN to XnN, YnN." The embroidery data also includes image data (image in a BMP format, for example; and not shown) displayed on the display 7*a*, and an image of embroidery pattern is displayed on the display 7*a* in colors allotted to respective thread color data.

The EEPROM 27 stores a needle bar thread color table in which the colors of thread spools 15 have correspondence relationships with the needle bars 10 respectively, as shown in FIG. 5. When change of thread spools 15 is necessary in the sewing, the display 7*a* displays a thread spool setting screen (not shown) on which thread colors are allotted to the respective needle bars 10 based on the thread color data of the embroidery data, as will be described in detail later. For example, when the thread colors are allotted to the needle bars 10 in a sequence of needle bar numbers as shown in FIG. 5, the user refers to the thread colors to set the thread spools 15 of "purple" to "red" corresponding to needle bar numbers 1 to 10 respectively, thereby carrying out thread guard of the needle thread 15*a*. The EEPROM 27 stores, as thread spool colors, thread colors of the needle threads 15*a*, that is, the thread colors of the thread spools 15 set on the spool bases 14, corresponding to needle bar numbers respectively. The EEPROM 27 is thus configured as a nonvolatile thread spool color storage unit that stores thread spool color data of the thread spools 15 set on the spool holder bases 14.

The thread spool color data is data of colors of the thread spools 15 and is defined by RGB values as will be described later. Since the EEPROM 27 stores thread color data of the embroidery data which have been selected by the user and have been caused to correspond to the needle bar numbers respectively, an input operation by the user is not necessary. The user can set the thread spool color data of the EEPROM 27 for every needle bar number on the basis of operation of the touch panel 7*b* according to user's preference, while viewing the display 7*a*. The touch panel 7*b* and the control device 6 thus constitute an input unit.

The number of thread spools 15 usable with the sewing machine M is larger than the number of thread spools (10 in the embodiment) that are settable on the spool holder bases 14. Accordingly, the EEPROM 27 stores thread spool color data of thread spools 15 usable with the sewing machine M. More specifically, the EEPROM 27 stores a 64 color pallet table (see a 64-color pallet 53 in FIG. 7) comprising RGB values of 64 colors and pallet color numbers 1 to 64 corresponding to the respective RGB values.

The EEPROM 27 further stores, as a 300-color pallet table (see a 300-color pallet 56*a* in FIG. 8), a plurality of colors selected from all the thread spool color data by the user aside from 64-color pallet table. The 300-color pallet table is a custom pallet table in which color numbers 1 to 300 by pallets corresponding to respective RGB values are settable according to user's preference. The EEPROM 27 is configured as a pallet storage unit (a full thread color storage unit) that stores data of thread colors whose number is larger than that of thread spools settable on the spool holder bases 14.

The color information area 266 of the RAM 26 temporarily stores the needle bar thread color table and thread spool color data of the 64-color or 300-color pallet table. Thus, the color information area 266 serves as a thread spool color storage unit and a full thread color storage unit.

The control device 6 serves as a random number generator that generates a random number using a function with an argument that is the number of thread spool color data in the needle bar thread color data, the 64-color pallet table or the 300-color pallet table. More specifically, the control device 6 generates a random number based on the number of thread spools 15 set on the spool holder bases 14 (in the range from 1 to 10, for example). The control device 6 checks one of the needle bar numbers of 1 to 10 of the needle bar thread color table corresponding to the generated random number, extracting RGB values or the like corresponding to the needle bar number. A random color extraction from the thread spool color data (ten colors in FIG. 5) of the needle bar thread color data will basically be referred to as a first mode.

On the other hand, the control device 6 generates a random number in the range (a range from 1 to 64, for example) of color numbers by pallet in the 64-color or 300-color pallet table. The control device 6 checks one of the color number by pallet of 1 to 64 of the 64-color pallet table corresponding to the generated random number, extracting RGB values or the like corresponding to the color bar number by pallet. A random color extraction from the thread spool color data of the 64-color or300-color pallet table will be referred to as a second mode.

The generation of embroidery data, or particularly, a screen displayed on the display 7*a* in coloration of thread color data will be described with further reference to FIGS. 6 to 11. Display screens 100 to 104 on the display 7*a* will be described with reference to FIGS. 6 to 11. Since the display 7*a* is a liquid-crystal color display, an image of embroidery pattern on the display screens 100 to 104, the 64-color and 300-color pallets 53 and 56*a* and the like are capable of multi-color display.

Figure 6:
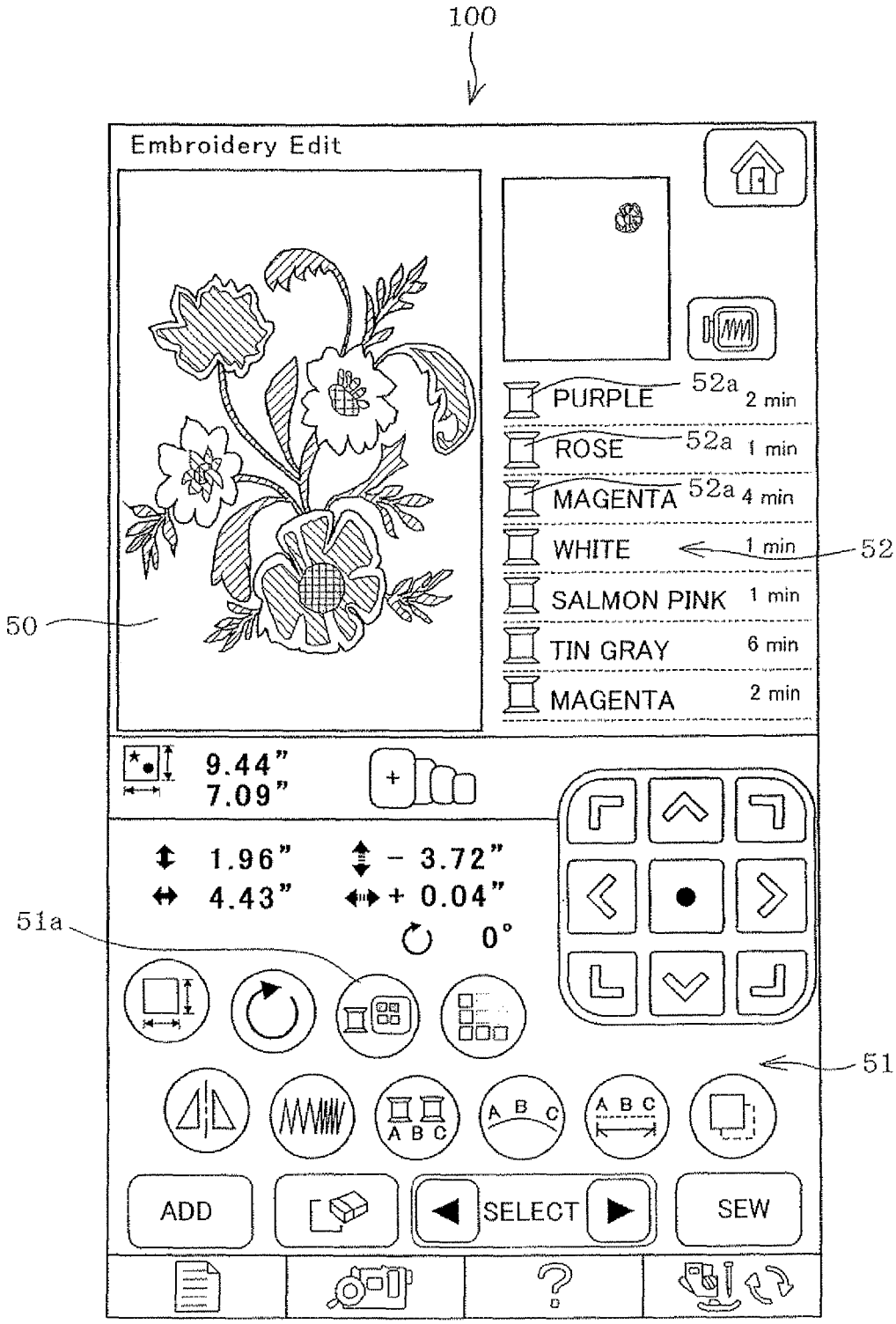
FIG. 6 exemplifies a menu screen in the generation of embroidery data.
Figure 7:
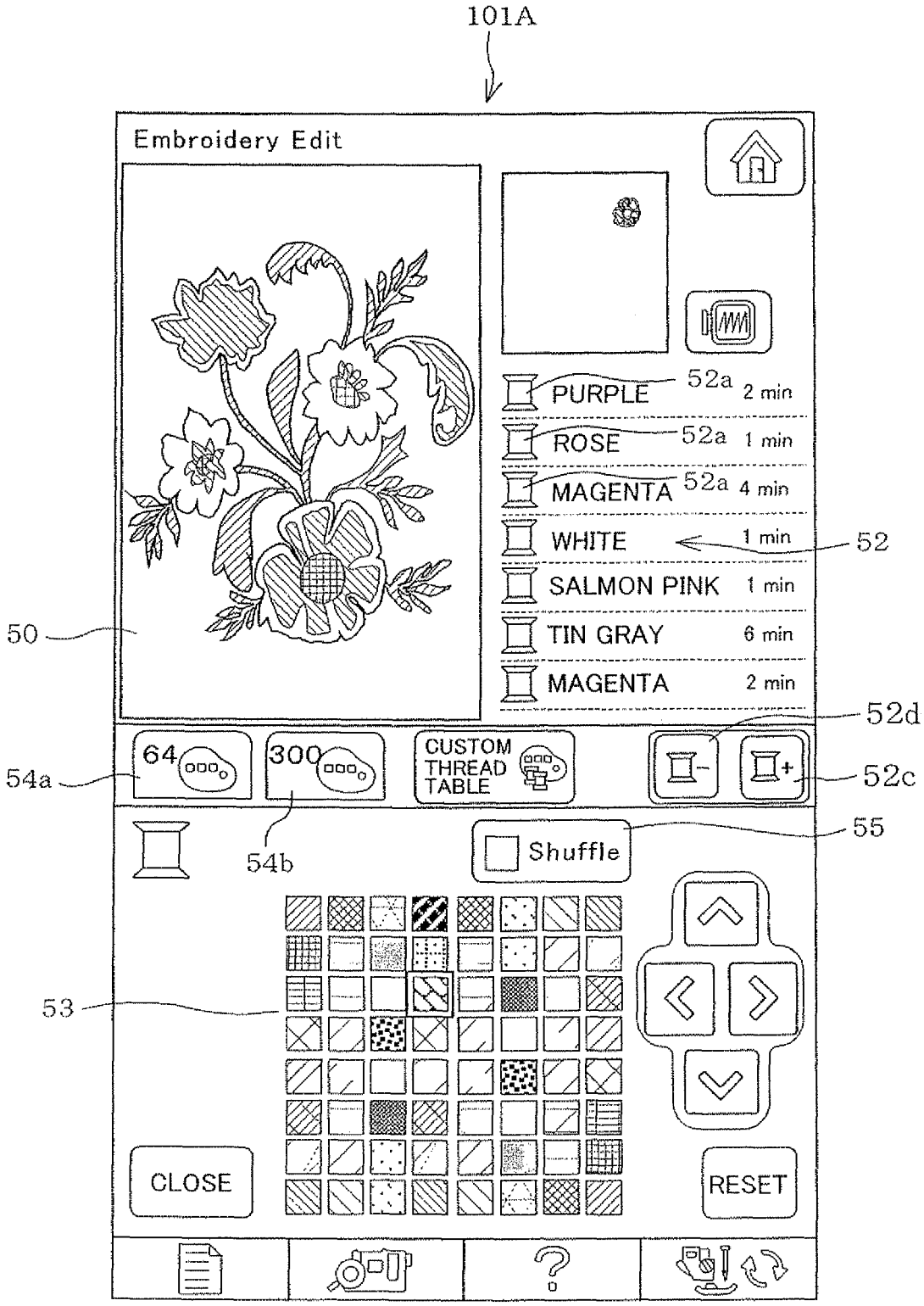
FIG. 7 exemplifies a first color change screen.

FIG. 6 exemplifies a menu screen 100 displayed before coloration is executed in generation of embroidery data. The menu screen 100 is provided with a preview image area 50 for displaying a preview image, a thread color data designation area 52, various input keys 51 including a thread color setting key, and the like. The preview image indicates a result of embroidering when embroidery is carried out on the basis of embroidery data corresponding to an embroidery pattern selected by the user. When a touch key corresponding to the thread color setting key 51*a* is depressed (hereinafter, "touched"), the display 7*a* is switched to a first color change screen 101A as shown in FIG. 7.

The first color change screen 101A is provided with the 64-color pallet 53, a plurality of pallet selecting keys 54*a* and 54*b* and a shuffle key 55 as well as the preview image area 50 and the thread color data designating area 52. Various settings relating to thread colors are executable on the first color change screen 101A. More specifically, the thread color data designating area 52 shows colors corresponding to the respective pattern-by-color portions in the preview image area 50 together with an illustration of the thread spools 52*a*. The user can designate a color he/she desires out of 64-color pallet 53 for every pattern part. For example, RGB values of color numbers 1 to 8 of the 64-color pallet table according to pallet are assigned to a top row of the 64-color pallet 53 sequentially from the left. Thus, the 64-color pallet 53 includes eight rows each of which further includes eight thread spool color data of the 64-color pallet table.

A plus key 52*c* and a minus key 52*d* are provided beneath the thread color data designating area 52. The plus key 52*c* and the minus key 52*d* are operated to scroll the thread spool 52*a* in the designated area 52. For example, when the total number n of colors by color composing the embroidery pattern 45 is 10, three currently non-displayed thread spools 52*a* can be displayed by touching the plus key 52*c* and/or minus key 52*d*.

Figure 8:
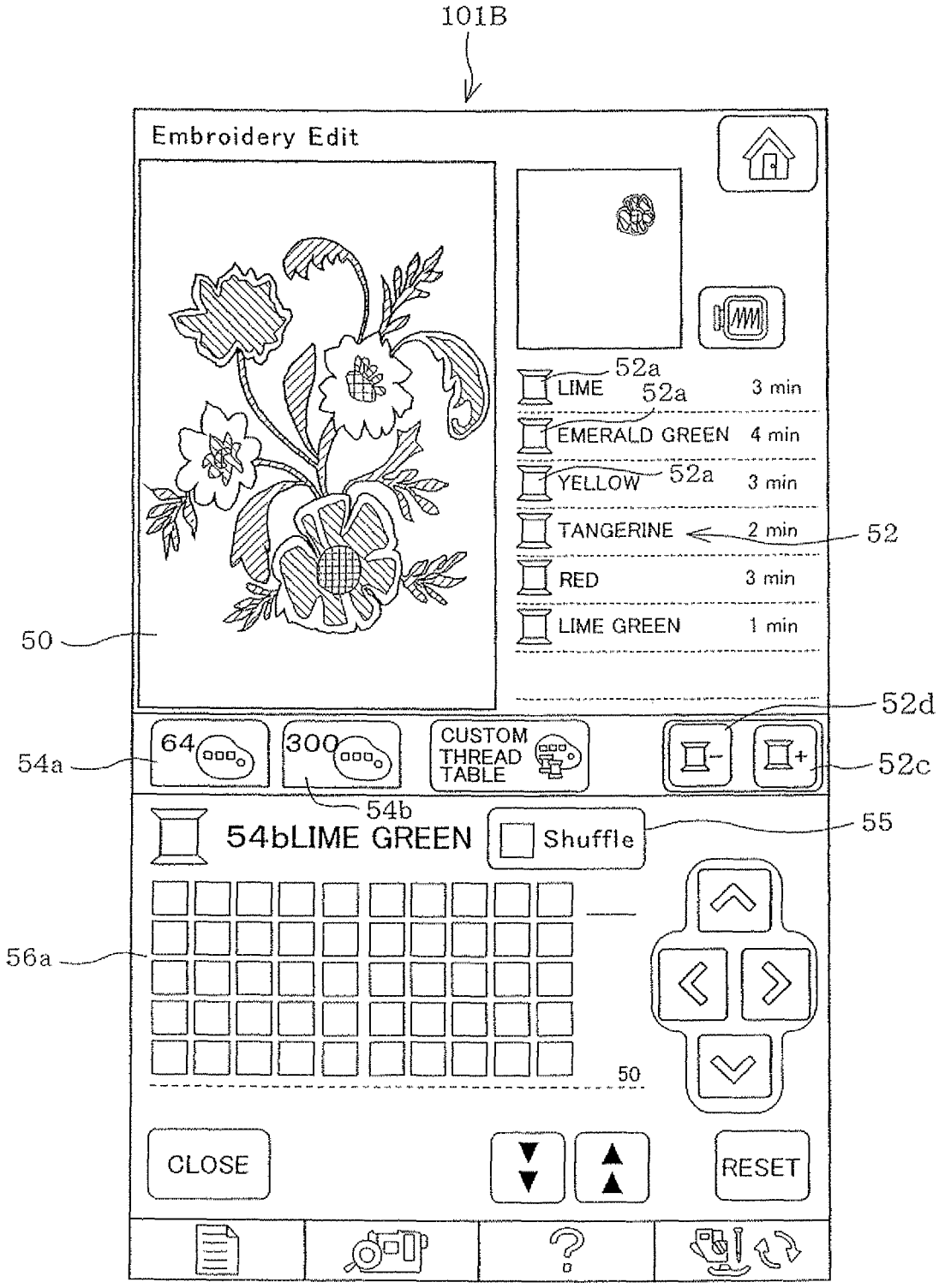
FIG. 8 exemplifies a second color change screen.
Figure 9:
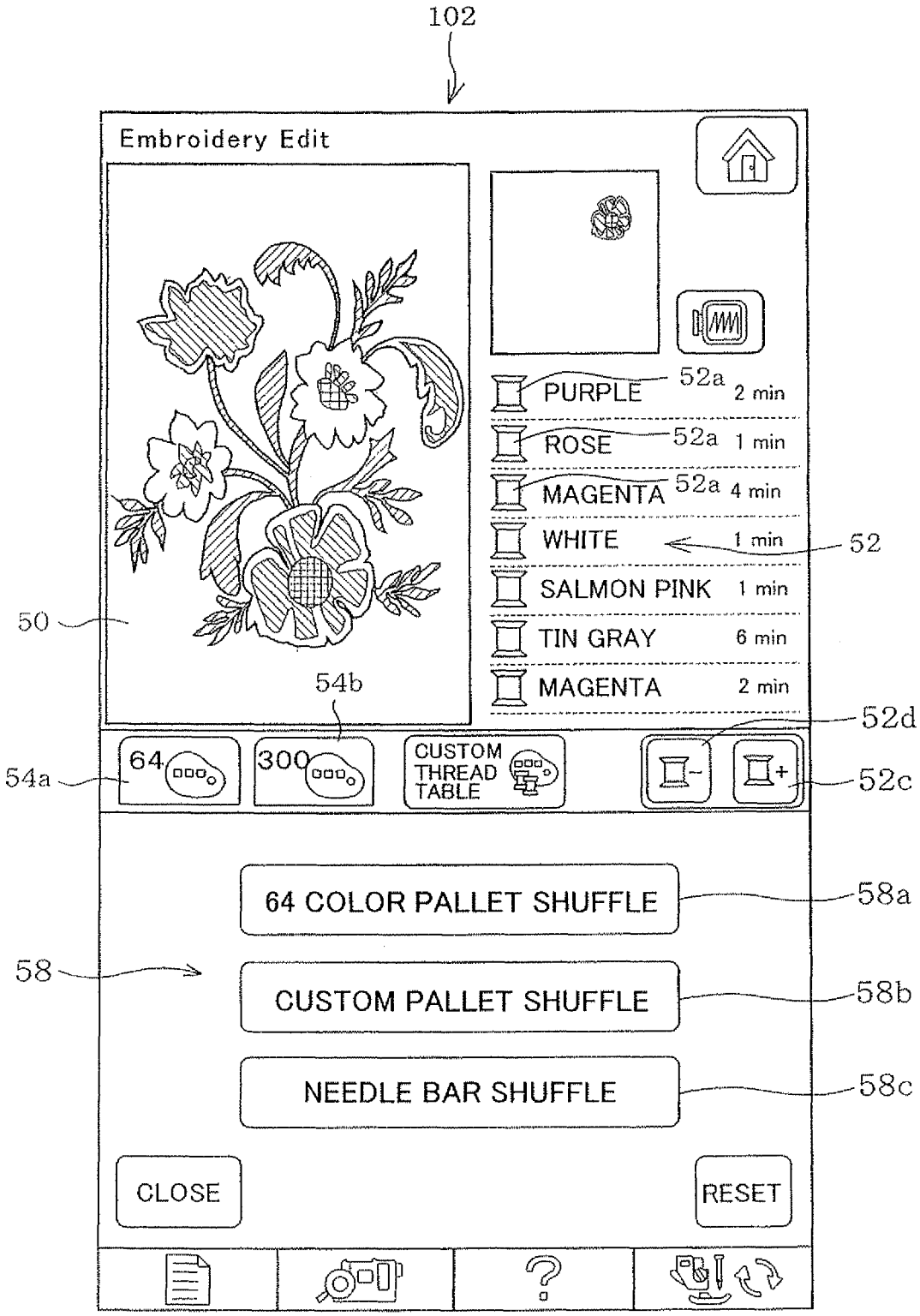
FIG. 9 exemplifies a mode setting screen.

FIG. 8 shows a second color change screen 101B which also includes a preview screen area 50 and the like as in the first color change screen 101A. The second color change screen 101B is further provided with a 300-color pallet 56*a*, instead of the 64-color pallet 53. The 300-color pallet 56*a* is capable of arranging 300 colors on a 300-square pallet at most on the basis of the RGB values and corresponds to the custom pallet table. FIG. 8 shows only a part (50 squares) of the 300-color pallet 56*a*. The first and second color change screens are switched therebetween by touching a pair of pallet selecting keys 54*a* and 54*b*. When the shuffle key 55 is touched, the first or second color change screen 101A or 101B is switched to a mode setting screen 102.

Figure 10:
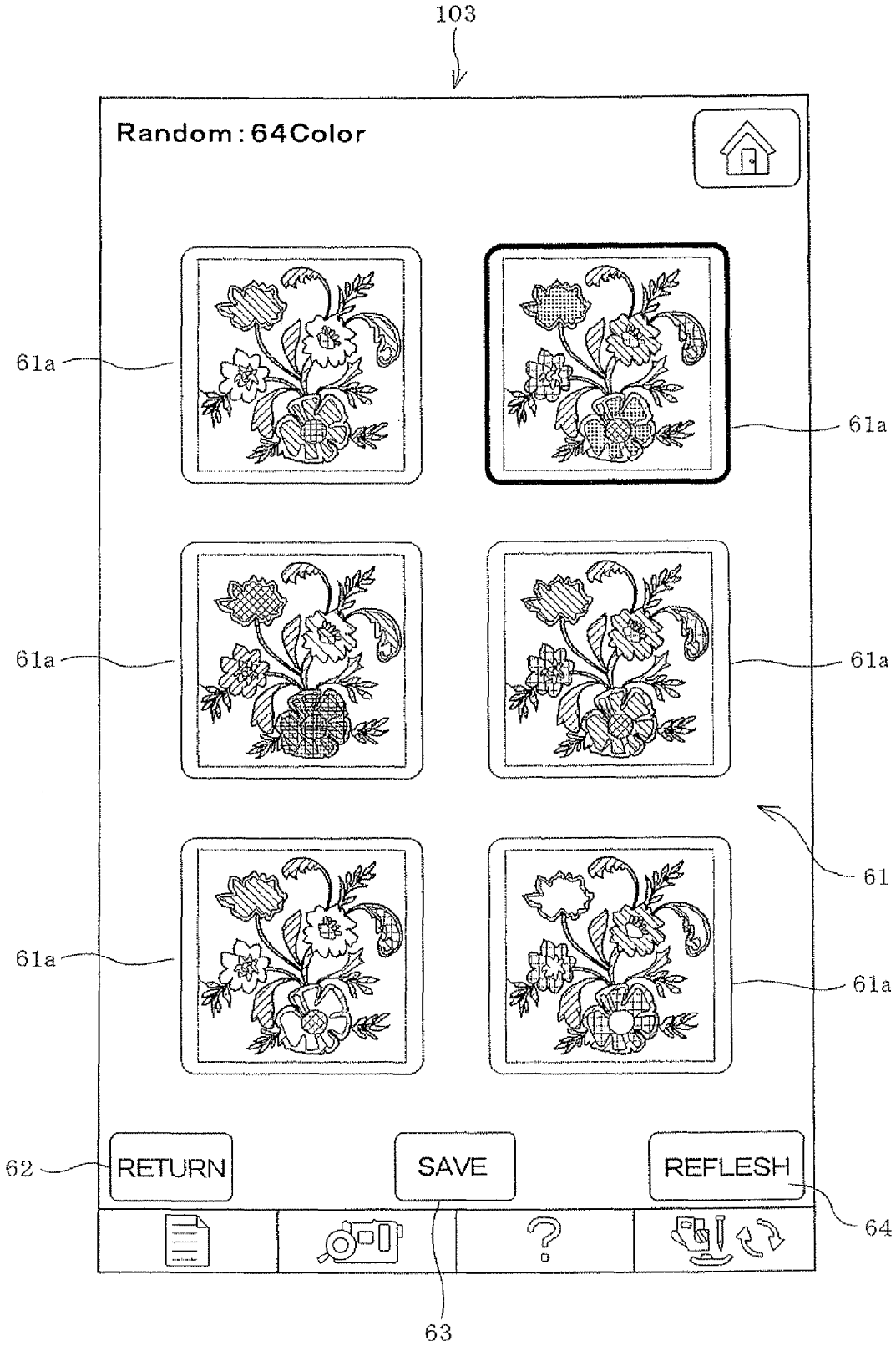
FIG. 10 exemplifies a thumbnail display screen.

The mode setting screen 102 is provided with a preview image area 50 and the like as a first color change screen 101A. The mode setting screen 102 is further provided with a mode setting section 58, instead of the 64-color pallet 53. The mode setting section 58 includes a 64-color pallet shuffle key 58*a*, a custom pallet shuffle key 58*b* and a needle bar shuffle key 58*c*. The display 7*a* is set to a first mode when the needle bar shuffle key 58*c* is touched to thereby be selected. The display 7*a* is set to a second mode when either 64-color pallet shuffle key 58*a* or custom pallet shuffle 58*b* is touched to thereby be selected. In the second mode, a color is extracted in a random manner from thread spool color data of the needle bar thread color table. Subsequently, the second mode is changed to a thumbnail display screen 103 as shown in FIG. 10. A mode selecting unit is thus constituted by the control device 6 and the touch panel 7*b* selecting the first or second mode.

The thumbnail display screen 103 includes an embroidery pattern selecting area 61 where a plurality of (6, for example) embroidery patterns is displayed, a return key 62, a save key 63 and a refresh key 64. The embroidery pattern selecting area 61 displays a thumbnail image 61*a* obtained by scaling down each one of images of a plurality of embroidery patterns generated using a color randomly extracted as the thread color data and having different color combinations. When the save key 63 and the thumbnail image 61*a* are touched in this sequence, embroidery data of the displayed embroidery pattern is stored on the EEPROM 27 as will be described later. Furthermore, when the refresh key 64 is touched to thereby be operated, data of a new extracted color is assigned to the thread color data, whereby new six embroidery patterns are displayed instead of those currently displayed. When the return key 62 is touched, the display 7*a* is returned to the mode setting screen 102. When the thumbnail image of the embroidery pattern is touched, the display 7*a* is changed to an enlarged display screen 104 as shown in FIG. 11.

The enlarged display screen 104 is provided with an enlarged image area 65, a closed key 66, a set key 67 and the like. The enlarged image area 65 displays an image of embroidery pattern obtained by enlarging the thumbnail image (an image 61*a* encompassed by a bold frame as shown in FIG. 10) selected in FIG. 10. When the closed key 66 is touched, the display 7*a* is returned to the thumbnail display screen 103. When the set key 67 is touched, the display 7*a* is returned to the menu screen 100 displaying an embroidery pattern of the enlarged image area 65 as an embroidery pattern of the preview image.

Figure 12:
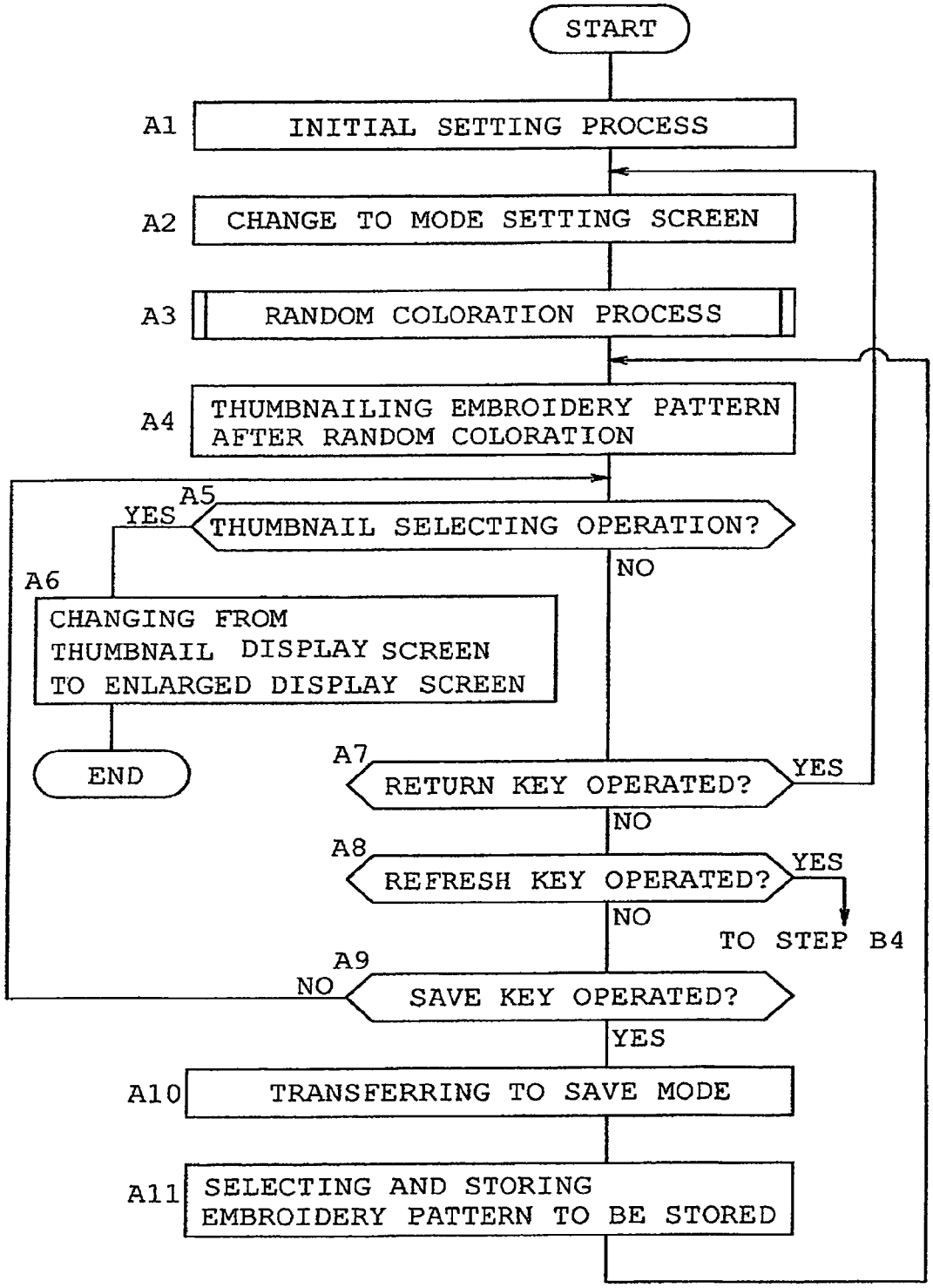
FIG. 12 is a flowchart showing setting of thread color data in an embroidery data generating process.
Figure 13A:
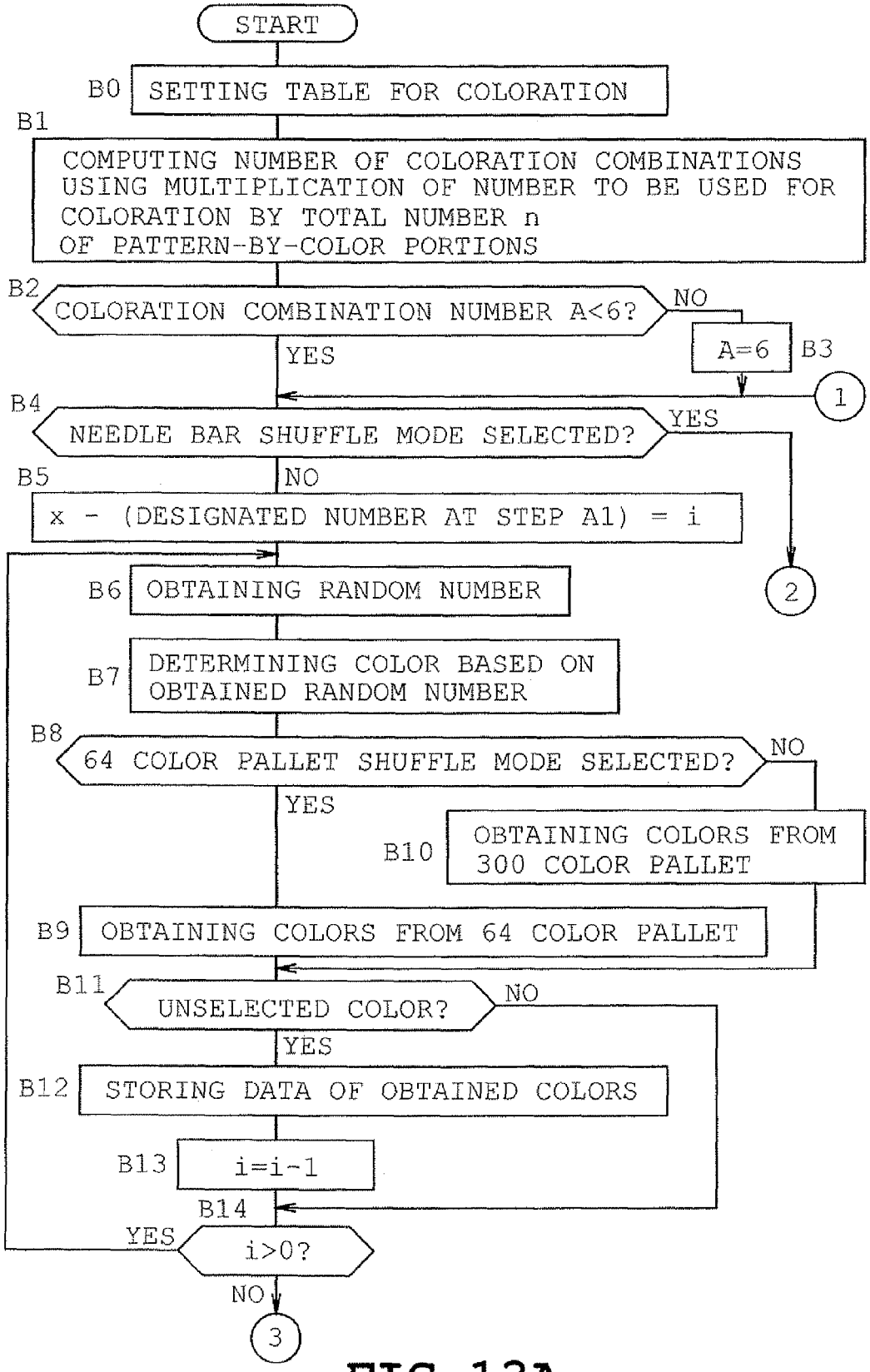
FIGS. 13A and 13B are flowcharts showing color extraction and assignment processes.
Figure 13B:
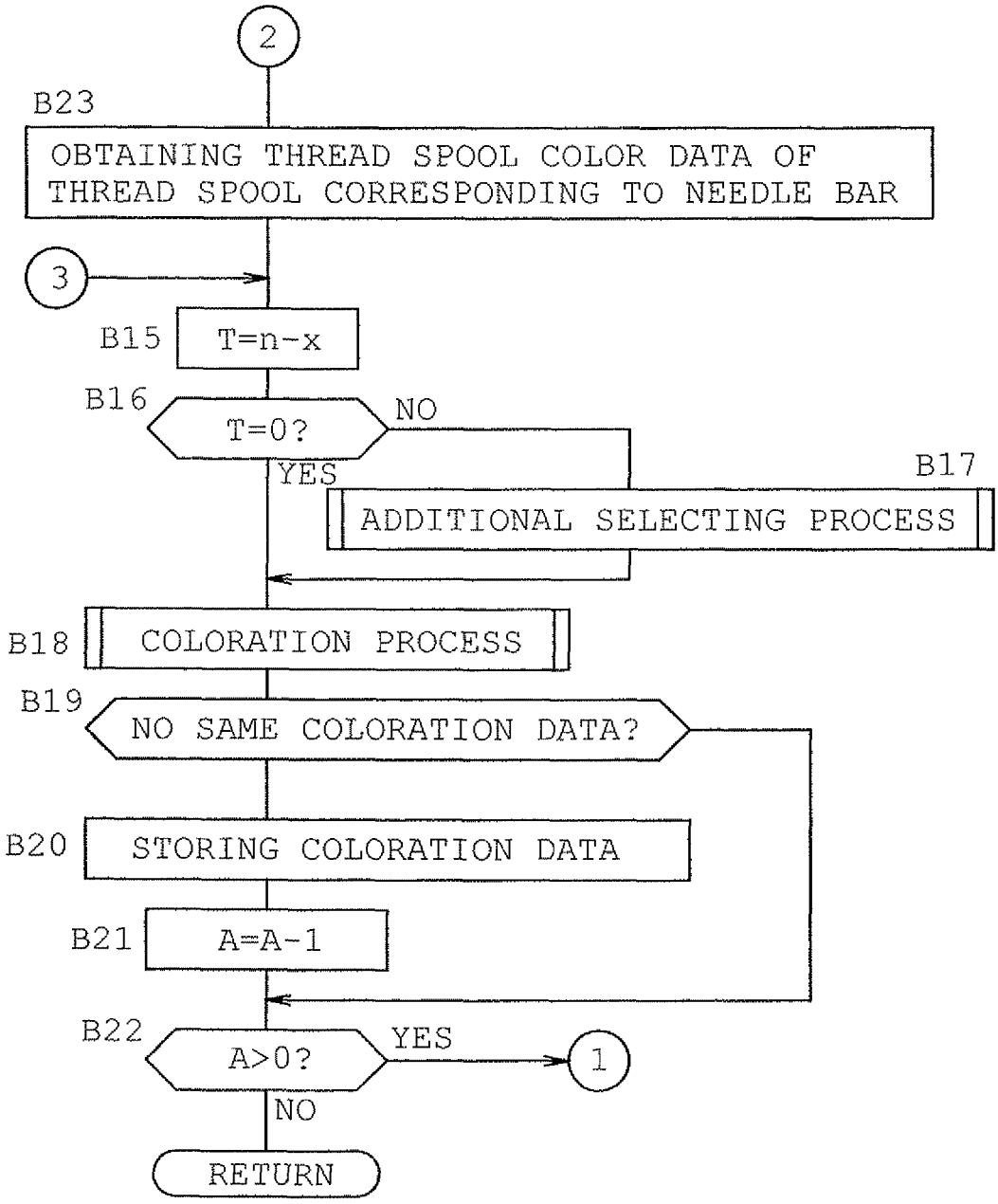

The operation of the embroidery data processing program will now be described with attention to coloration regarding the thread color data with reference to FIGS. 12 to 15, which are flowcharts showing processing procedures the control device 6 executes based on the embroidery data processing program. Referring to FIG. 12, various setting processes are carried out with respect to the embroidery pattern at step A1. More specifically, the user touches the touch panel 7*b* so that embroidery data is read from the ROM 25, and a pattern selecting screen (not shown) of the display 7*a* is displayed according to the embroidery data. When a desired one of a plurality of embroidery patterns on the pattern selecting screen is selected by a touch operation, the display 7*a* is switched to the menu screen 100 of FIG. 6 displaying the embroidery pattern.

The user then changes the display 7*a* from the menu screen to the thread spool setting screen and sets on the spool holder bases 14 the thread spools 15 necessary for sewing the selected embroidery pattern. For example, it is assumed that the total number of pattern-by-color portions of the embroidery pattern (corresponding to "n" in FIG. 4) is ten and thread colors of the pattern-by-color portions are assigned to the pattern-by-color portions in the sequence of needle bar numbers as shown in FIG. 5. In this case, referring to the thread colors, the user sets ten thread spools 15 of purple to red corresponding to needle bar numbers 1 to 10 respectively and carries out thread guard of the needle threads 15*a*. Thread colors of the thread spools 15 set on the spool holder bases 14 or thread color data of the selected embroidery pattern are stored on the EEPROM 27 as thread spool color data while associating the thread color data with the needle bar numbers. The thread spool setting screen is returned to the menu screen after the thread spools 15 have been set on the spool holder bases 14.

The user then touches the thread color setting key 51*a* on the menu screen 100 to change the display 7*a* to the first color change screen 101A in FIG. 7. In this case, when the user does not wish to change the colors of pattern-by-color portions regarding the embroidery pattern in the preview image area 50 of the first color change screen 101A, he or she designates colors of the thread spools 52*a* in the relevant thread color data designating areas 52. Thus, designated colors are stored in an extraction data storage area 269 of the RAM 26. The upper limit of the designated number of colors is set to total number n of pattern-by-color portions in the embroidery pattern. Accordingly, the processing is completed when color designation has been carried out for all the pattern-by-color portions at step A1.

Thread color data corresponding to the thread spools 52*a* in the thread color data designation area 52 can be designated from the 64-color pallet 53 or the 300-color pallet 56*a*. In this case, the 300-color pallet 56*a* (the second color change screen 101B) can be displayed when a pallet selecting key 54*b* is touched on the first color change screen 101A. When the shuffle key 55 is then touched, the first color change screen 101A is changed from the second color change screen 1015 to the mode setting screen 102 (step A2).

When any one of the 64-color pallet shuffle key 58*a*, custom pallet shuffle key 58*b* and needle bar shuffle key 58*c* has been touched on the mode setting screen 102, random coloration processing is started (see step A3). More specifically, when the needle bar shuffle has been set, a needle bar thread color table is read from the EEPROM 27 at step B0 in FIG. 13A to be expanded to the color information storage area 266 of the RAM 26. On the other hand, when the 64-color pallet shuffle or the custom pallet shuffle has been set, the 64-color or 300-color pallet table is stored on the color information storage area 266. Thus, the total number p of colors in the color information storage area 266 is 10 at most in the case of the needle bar shuffle. The total number p of colors is 64 in the case of the 64-color pallet shuffle, and the total number p of colors is 300 in the case of the custom pallet shuffle.

The control device 6 then proceeds to step B1 to compute the number A of combinations of coloration of the embroidery pattern, based on the total number n of pattern-by-color portions in the selected embroidery pattern and the number of colors (set number x of colorations) used regarding the pattern-by-color portion. In the example, the set coloration number x equals the total number of types of thread color data in the embroidery data, corresponding with the total number n (x=n) when colors of the pattern-by-color portions differ from each other or one another. A color number setter (not shown) operated by the user to input the set coloration number may be changed. For example, the color number setter may be displayed on the display 7*a* (screen).

In the example, six embroidery patterns having different colorations from one another are displayed on a thumbnail display screen 103, for example. The number A of necessary combinations is computed with the use of combination in order that the combinations may be prevented from overlap. Accordingly, for example, when the set coloration number x is 1 and the total number n of pattern-by-color portions is 1, the combination number A is represented as ${}_pC_1$. Thus, the coloration combination number A bears a proportionate relationship to the total color number p in the needle bar thread color table. The combination number A is not less than six when the total number p is not less than 2 and the set coloration number x is not less than 3. In this case, the control device 6 determines in the negative (NO) at step B2, proceeding to step B3 to execute settings for generation of six embroidery data. On the other hand, when the combination number A is less than six (YES at step B2), the corresponding number of embroidery data is generated.

The control device 6 determines at step B4 whether or not the sewing machine M is in a needle bar shuffle mode. More specifically, when 64-color pallet shuffle or custom pallet shuffle is set in the second mode (NO at step B4), colors necessary for coloration of the embroidery pattern are selected from the 64-color or 300-color pallet table (steps B5 and so on). On the other hand, when the needle bar shuffle is set in the first mode (YES at step B4), colors necessary for coloration of the embroidery pattern are extracted from the needle bar thread color table, that is, from the colors of the thread spools 15 set on the spool holder bases 14 (step B23).

More specifically, in the second mode, firstly, when the number of pattern-by-color portions the user does not desire to change (the number of pattern-by-color portions designated at step A) is subtracted from the set coloration number x, the number i of types of colors extracted from a single embroidery pattern is computed (step B5). The control device 6 then generates a random number in the range of the total number p in the 64-color or 300-color pallet table in the color information storage area 266. For example, when the 64-color pallet 53 has been set as the pallet used for coloration, the control device 6 generate a random number in the range of 1 to 64 (step B6). Subsequently, the control device 6 randomly extracts a color based on the obtained random number and the pallet table set by the user (steps B7 to B10). In more detail, when the 64-color pallet table is set in the color information storage area 266 (YES at step B8), the control device 6 checks one of the color-by-pallet numbers 1 to 64 of the 64-color pallet table corresponding with the generated random number. The control device 6 extracts a color (RGB values) corresponding to the relevant color-by-pallet number (step B9). When the extracted color does not overlap the color designated at step A1 (YES at step B11), the control device 6 stores the extracted color in the extracted data storage area 269 of the RAM 26 (step B12).

The number i of color types is updated into i=i−1 every time the extracted color is stored in the extracted data storage area 269 (step B13). Furthermore, steps B6 to B11 are also executed regarding extraction of second or subsequent colors (YES at step B14). When the extracted colors do not overlap the already extracted colors or the color designated at step A1 (YES at step B11), the control device 6 executes storing of the extracted color and subtraction of number i in the same manner as the first color. Steps B6 to B14 are repeatedly executed until the color type number i is determined to be not more than 0 (NO at step B14). Consequently, the colors used for a single embroidery pattern, that is, the color designated at step A1 and the colors extracted at steps B6 to B14 are stored in the extracted data storage area 269 without overlap.

The control device 6 then computes a deficiency number T that is the difference between the total number n of pattern-by-color portions and the set coloration number x (step 815). When the computation results in the deficiency number T (NO at step B16), the control device 6 proceeds to an additional selection process (step B17).

Figure 14:
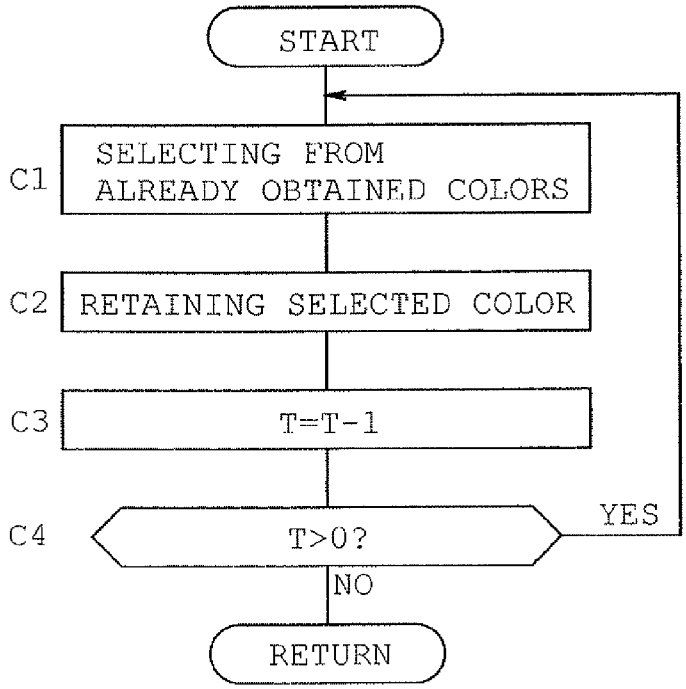
FIG. 14 is a flowchart showing an additional selecting process.

More specifically, as shown in FIG. 14, a color is selected from the extracted data storage area 269 at step C1 in an additional selection process in order that the number n of pattern-by-color portions may be equal to the number of colors in the extracted data storage area 269 as a prerequisite for the coloration process. In this case, the control device 6 generates a random number in the range of the total number of colors stored in the storage area 269 in the same manner as described above thereby to randomly select the color from the colors stored in the extracted data storage area 269. The selected color is additionally stored in the extracted data storage area 269 (step C2) and the deficiency number T is updated into T=T−1 (step C3). Steps D1 to D4 are repeatedly executed until the deficiency number T becomes 0 (NO at step C4). Consequently, in the first mode, colors the number of which is the same as the total number n of pattern-by-color portions are extracted using a needle bar thread color table, that is, the thread colors of the thread spools 15 to be set on the spool holder bases 14, thereby being stored in the extracted data storage area 269. When the number of colors stored in the extracted data storage area 269 corresponds with the total number n of pattern-by-color portions (NO at step C4 or YES at step B16), the control device 6 proceeds to a coloration process (step B18).

Figure 15:
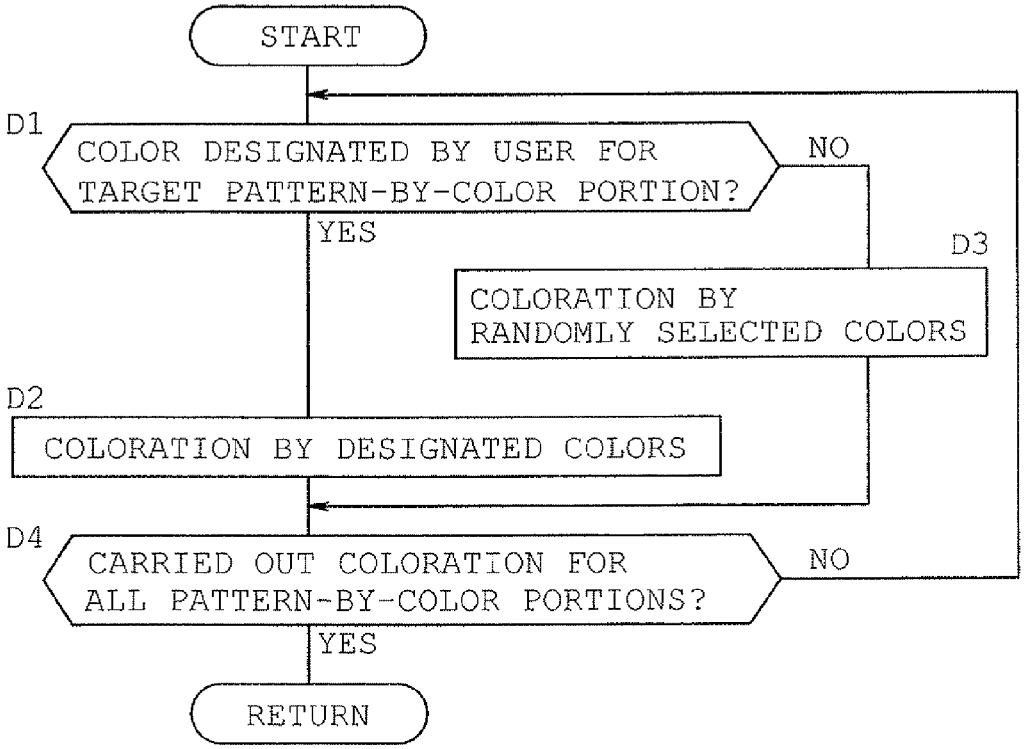
FIG. 15 is a flowchart showing a coloration process for every embroidery pattern.

In the coloration process, the control device 6 determines whether or not thread color data of each pattern-by-color portion includes user's designation (the designation at step A1) (step D1), as shown in FIG. 15. When one or more thread color data include user's designation, the relevant color is assigned (step D2). When no thread color includes user's designation, a randomly extracted color is assigned (step D3). The colors stored in the extraction data are shuffled in the assignment. More specifically, even when the additional selection process is executed so that a color overlapping the previously stored color is stored in the extracted data storage area 269, a rearranging process as will be described later is executed to rearrange a plurality of colors in the extracted data storage area 269, whereby randomness is ensured in the coloration. Thus, when repeatedly executing steps D1 to D4 at the number of times corresponding to the number n of pattern-by-color portions, the control device 6 returns to step B19 in FIG. 13B.

When completing the coloration of the first embroidery pattern by the above-described process, the control device 6 stores all the thread color data on the RAM 26 (YES at step B19 and step B20). The control device 6 then updates the combination number A into A=A−1 (step B21), thereafter returning to step B4 (YES at step B22). Furthermore, steps B4 to B19 are also executed for the coloration of second and subsequent embroidery patterns. When the coloration of second embroidery pattern or subsequent one of embroidery patterns differs from already generated one (YES at step B19), the storing of the thread color data and the subtraction of combination number A are executed in the same manner as the first one (steps B20 and B21). The control device 6 repeatedly executes steps B4 to B22 until determining that number A is not more than 0 (NO at step B22), whereupon the A-number of combinations of embroidery patterns having different colorations is generated. Subsequently, the control device 6 returns to step A4 in FIG. 12.

The following process will be executed in the first mode (YES at step B4 in FIG. 13A) differing from the above-described second mode and set to "needle bar shuffle." More specifically, in the first mode, the thread spool color data of the needle bar thread color table stored in the color information storage area is stored in the extracted data storage area without any change except for one or more colors overlapping the color designated at step A1 (step B23). The control device 6 then computes a deficiency number T that is the difference between the total number n of pattern-by-color portions and the set coloration number x (step B15). When the computation results in the deficiency number T (NO at step B16), the control device 6 proceeds to an additional selection process (step B17).

More specifically, as shown in FIG. 14, a color is selected from the extracted data storage area 269 at step C1 in the additional selection process in order that the number n of pattern-by-color portions may be equal to the number of colors in the extracted data storage area 269 as a prerequisite for the coloration process. In this case, the control device 6 generates a random number in the range of the total number of colors stored in the storage area 269 in the same manner as described above to thereby randomly select the color from the colors stored in the extracted data storage area 269. The selected color is additionally stored in the extracted data storage area 269 (step C2) and the deficiency number T is updated into T=T−1 (step C3). Steps D1 to D4 are repeatedly executed until it is determined that the deficiency number T becomes 0 (NO at step C4). Consequently, in the first mode, colors the number of which is the same as the total number n of pattern-by-color portions are extracted using thread colors of the thread spools 15 set on the needle bar thread color table, that is, the spool holder bases 14, thereby being stored in the extracted data storage area 269.

When the number of colors stored in the extracted data storage area 269 corresponds with the total number n of pattern-by-color portions (NO at step C4 or YES at step B16), the control device 6 proceeds to the coloration process (step B18). In the coloration process as shown in FIG. 15, the control device 6 determines whether or not thread color data of each pattern-by-color portion includes user's designation or the designation at step A1 (step D1). When one or more thread color data include user's designation, the relevant color is assigned (step D2). When no thread color includes user's designation, a color of the needle bar thread color table is assigned (step D3). The colors stored in the extracted data storage area 269 are assigned. In the latter assignment, a rearranging process is executed to cancel a plurality of colors in the extracted data storage area 269 and to rearrange canceled colors, whereby colors are shuffled.

For example, when coloration is executed using only the thread spools 15 set on the spool holder bases 14 without user's designation at step A1, a random number (a range from 1 to 10, for example) is generated based on the number of thread spools 15 set on the spool holder bases 14. The control device 6 checks the needle bar number of 1 to 10 of the needle bar thread color table corresponding to the generated random number, extracting RGB values corresponding to the needle bar number. Thus, the process is repeatedly executed using the random number until all the colors are extracted from the extracted data storage area 269, so that the colors are rearranged in the order of extraction. The rearranged colors are assigned to the respective pattern-by-color portions, whereby coloration is executed in which the colors predetermined regarding the embroidery pattern are shuffled.

On the other hand, colors can be shuffled using random numbers even when a color not included in the needle bar thread color table is designated at step A1 or overlapping colors are stored in the extracted data storage area 269 at step C1. For example, when the user has designated a color, the color is assigned (step D2). When the user has not designated any color, a random number is used so that a relevant color is extracted from the extracted data storage area 269 to be assigned to the pattern-by-color portion (step D3).

Thus, when steps D1 to D4 are repeatedly executed at the number of times corresponding to the number n of pattern-by-color portions and the coloration is completed, the control device 6 returns to step B19 in FIG. 135. The extraction process and the assignment process should not be limited to a manner of steps B4 to B23, C1 to C4 and D1 to D4 but may be any manner including a step of randomly extracting and assigning a color.

When completing the coloration of the first embroidery pattern by the above-described process, the control device 6 stores the full thread color data on the RAM 26 (YES at step B19; and step B20). The control device 6 then updates the combination number A to A=A−1 (step B21), returning to step B4 (YES at step B22). Furthermore, regarding the coloration of second and subsequent embroidery patterns, the control device 6 executes steps B23 and B15 to B19. When the coloration of second embroidery pattern or subsequent one of embroidery patterns differs from already generated one (YES at step B19), the storing of the thread color data and the subtraction of combination number A are executed in the same manner as the first one (steps B20 and B21). The control device 6 repeatedly executes steps B4, B23 and B15 to B22 until determining that number A is not more than 0 (NO at step B22), whereupon the A-number of combinations of embroidery patterns having different colorations is generated. Subsequently, the control device 6 returns to step A4 in FIG. 12.

At step A4, thumbnail images of A-number of embroidery patterns having different colorations are displayed on the thumbnail display screen 103. Six such thumbnail images are shown in FIG. 10, for example. The thumbnail images can be obtained by reducing the sizes of the original images. In this case, when a right upper thumbnail image 61*a* of embroidery pattern is touched in FIG. 10 (YES at step A5), for example, the thumbnail display screen 103 is changed to an enlarged display screen 104 as shown in FIG. 11 (step A6). An embroidery pattern obtained by enlarging the selected thumbnail image is displayed on the enlarged display screen 104. Subsequently, when a set key 67 is touched, the enlarged display screen 104 is returned to a menu screen 100 displaying an embroidery pattern in an enlarged image area 65 as the embroidery pattern of the preview image (End).

When a return key 62 is touched on the thumbnail display screen 103 (YES at step A7), the control device 6 proceeds to step A2 to display a mode setting screen 102, so that various setting processes can be re-executed for the random coloration process. Furthermore, when a refresh key 64 is touched (YES at step A8), the control device 6 proceeds to step B4 to execute the random coloration process again. As a result, newly extracted colors are assigned to the thread color data, and new six embroidery patterns are displayed instead of the currently displayed six embroidery patterns.

On the other hand, when a save key 63 is touched on the thumbnail display screen 103 (YES at step A9), the control device 6 proceeds to a save mode (step A10). When any one or a plurality of the thumbnail images 61*a* is touched to thereby be selected, embroidery data of the relevant embroidery pattern is stored on the EEPROM 27 (step A11).

The control device 6 thus serves as an extraction unit and an assignment unit and executes an extraction routine of randomly extracting colors to be used as the thread color data and an assignment routine of assigning the extracted colors as the thread color data of the pattern-by-color portions, at steps B4 to B23. Strictly speaking, steps C1 to C4 and B4 to B17 correspond to the extraction routine, and steps D1 to D4 correspond to the assignment routine.

The sewing machine M can execute sewing for every pattern-by-color portion based on desired data of embroidery patterns which have newly been colored. In the sewing, when coloration has been executed for the embroidery data only with the use of colors of the needle bar thread color table in the first mode, the thread spools 15 set on the spool holder bases 14 need not be replaced. Accordingly, a variety of coloration patterns can be obtained by the thread colors of the thread spools 15 set on the spool holder bases 14, with the result that the usability of the sewing machine M can be improved.

On the other hand, for example, when colors other than those of the needle bar thread color table are designated at step A1 or when colors are selected from the 64-color or 300-color pallet table for coloration in the second mode, the user changes the display to the thread spool setting screen to change the thread spools 15 to those necessary for the sewing of the embroidery pattern. In this case, the thread spool color data of the thread spools 15 to be set on the spool holder bases 14 need not be input by the user separately as described above, whereupon sewing can be executed on the basis of the desired embroidery data.

Furthermore, user's favorite thread spool color data can be set for every needle bar number on the thread spool setting screen by the input unit. More specifically, the thread spool color data stored on the EEPROM 27 is renewed to desired colors, for example, needle bar No. 1 in FIG. 5 is renewed to a red needle thread 15*a* (thread spool 15), needle bar No. 2 to a yellow needle thread 15*a*, needle bar No. 3 . . . . Alternatively, when no thread spool color data corresponding to needle bar No. 10 is present, for example, desired thread spool color data is additionally stored for the needle bar No. 10. Thus, thread spool color data input by the user is preferentially stored on the EEPROM 27, and a thread spool 15 of the corresponding thread color is set on the spool holder base 14. Upon execution of the embroidery data processing program, colors are extracted from the renewed thread spool color data stored on the EEPROM 27. Accordingly, random coloration can be carried out with the use of favorite colors of the thread spools 15 input by the user. Additionally, step A1 serves as a thread spool color storage routine of storing, on the thread spool color storage unit, colors of a plurality of thread spools 15 set on the spool holder bases 14 as the thread spool color data.

The sewing machine M of the example thus executes a thread spool color storage routine of storing, on the thread spool color storage unit, colors of a plurality of thread spools 15 set on the spool holder bases 14 as the thread spool color data and an extraction routine of randomly extracting the colors to be used as thread color data from the thread spool color storage unit and an assignment routine of assigning the extracted colors.

Consequently, a random coloration can be executed by assigning the colors extracted in the extraction routine to the thread color data of the pattern-by-color portions of the embroidery pattern. Accordingly, the coloration of the embroidery pattern can easily be executed while troublesome works such as confirmation and designation of the thread color data can be eliminated. Furthermore, coloration with unexpectedness or surprise can be realized regarding embroidery patterns, and a variety of coloration patterns can be obtained without restrictions of established colorations. In particular, the sewing machine M is configured so that colors are randomly extracted from thread spool color data of a plurality of thread spools to be set on the spool holder bases 14 in the extraction routine. Since this can allow the thread spools 15 set on the spool holder bases 14 to be used without any change, further thread spools need not be prepared, and user's troublesome work pertaining to coloration or sewing can be eliminated.

The control device 6 and the touch panel 7*b* both pertaining to the execution of step A1 serve as a pattern selecting unit which selects a desirable one of embroidery data. Furthermore, thread color data of the pattern-by-color portions contained in the embroidery data selected by the pattern selecting unit is stored as thread spool color data in the thread spool color storage routine. Consequently, the trouble of inputting the thread spool color data can be eliminated, and both coloration and sewing can be executed by the use of the thread spools 15 corresponding to thread color data of the selected embroidery pattern when the thread spools 15 are set on the spool holder bases 14.

The sewing machine M is provided with the input unit which inputs the thread spool color data of a desirable thread spool 15 and is configured to preferentially store the thread spool color data input by the input unit in the thread spool color storage routine. According to this configuration, since a favorite color can be input as the thread spool color data by the input unit, the user can his/her favorite color can easily be adopted while a random coloration is carried out.

The control device 6 executes the mode selecting routine of selecting the first mode in which the thread spool color data to be used as the thread color data of the pattern-by-color portions at step B4 is extracted from the thread spool color data of the thread spool color storage unit or the second mode in which the aforesaid thread spool color data to be used at step B4 is extracted from the thread spool color data of the full thread color storage unit. The full thread color storage unit stores thread spool color data of the thread spools the number of which is larger than the number of the thread spools 15 settable on the spool holder bases 14 regarding thread spools usable with the sewing machine M. Accordingly, when the second mode is selected for execution of coloration, a larger number of coloration patterns can easily be obtained without limitation to the thread colors of the thread spools 15 set on the spool holder bases 14.

The display 7*a* is configured to display an embroidery pattern in colors assigned to the thread color data of the respective pattern-by-color portions. Accordingly, colors of the respective pattern-by-color portions can visually be gotten easily in the generated embroidery data.

The thumbnail display screen 103 of the display 7*a* is configured to present a plurality of candidates for embroidery patterns employing random coloration and having different color combinations. A desirable embroidery data can be selected from the candidates to be stored on the EEPROM 27. Consequently, operator's usability can be improved and embroidery data with the coloration according to user's preference and sensibility can easily be obtained.

SECOND EXAMPLE

Figure 16:
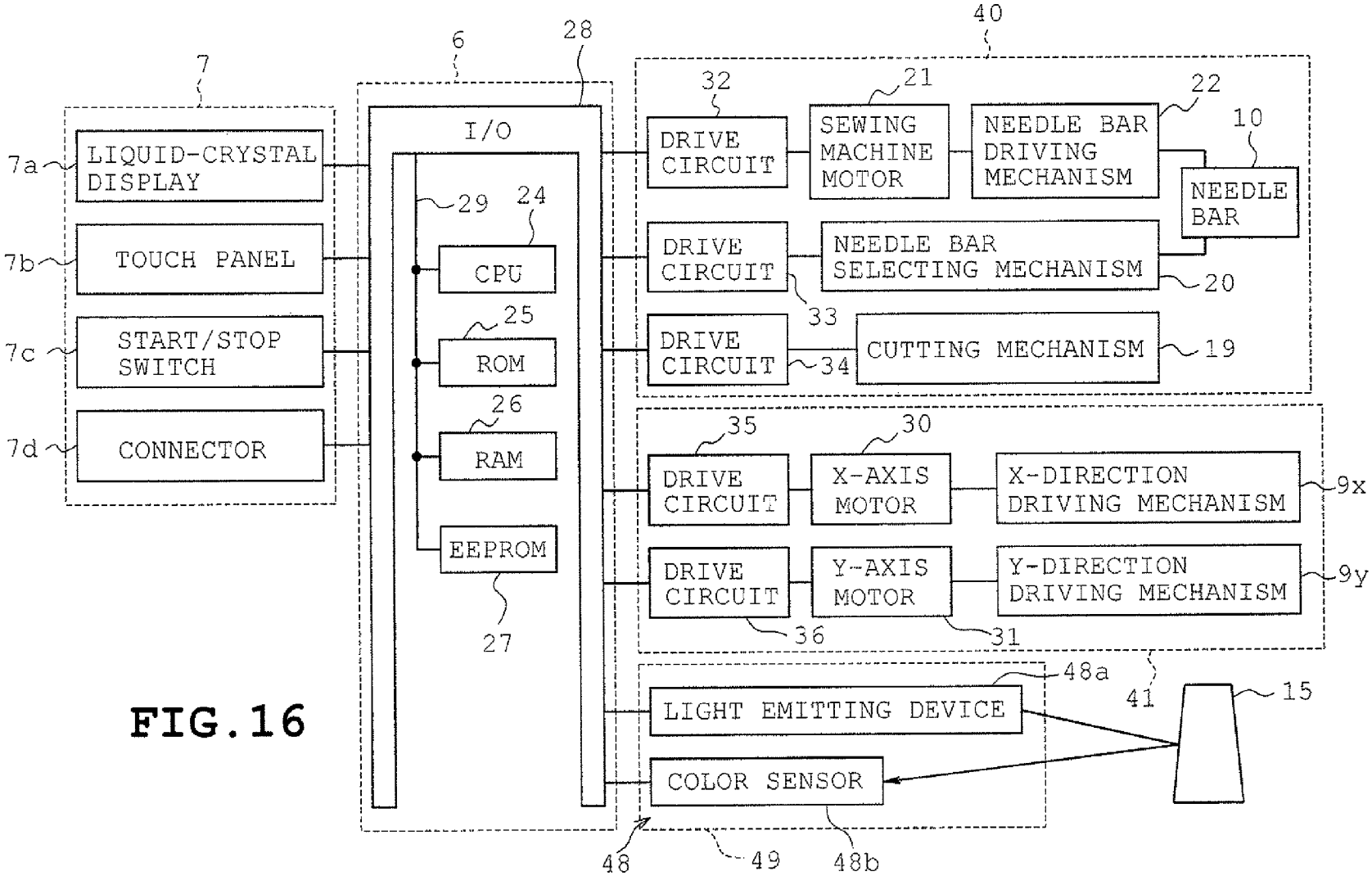
FIG. 16 is a view similar to FIG. 2, showing a second example.

FIG. 16 illustrates a second example. The differences between the first and second examples will be described below. For example, ten color detectors 48 (only one shown in FIG. 16) are provided on the paired spool holder bases 14 so as to correspond to the respective thread spools 15. The color detectors 48 are mounted on the spool holder bases 14 by respective supports 49 (only one shown in FIG. 16) so as to be adjacent to the respective thread spools 15. The color detectors 48 are configured as a detection unit which detects thread colors of the thread spools 15 on the spool holder bases 14 respectively. More specifically, each color detector 48 includes a light-emitting device 48*a* which irradiates the thread spool 15 (the needle thread 15*a*) as a detected object with light and a color sensor 48*b* which delivers RGB values corresponding to light reflected on the thread spool 15. The light-emitting device 48*a* and the color sensor 48*b* are mounted integrally on each spool holder base 14 by the support 49. Furthermore, the light-emitting devices 48*a* and the color sensors 48*b* are electrically connected to the I/O interface 28. When the light reflected on the thread spools 15 is input to the respective color sensors 48*b* while the thread spools 15 are set on the spool holder bases 14, the color sensors 48*b* deliver RGB values according to a wavelength of the reflected light.

According to the above-described construction, the RGB values of the thread spools 15 set on the spool holder bases 14 are detected by the color detectors 48, respectively. The detected RGB values are stored on the EEPROM 27 while having corresponding relationship to the relevant needle bar Nos. respectively. Consequently, the trouble of inputting the thread spool color data can be eliminated, and a coloration pattern can easily be obtained using the colors of the thread spools 15 actually set on the spool holder bases 14. Additionally, the detection unit may be composed of a CMOS image sensor or a CCD image sensor.

THIRD EXAMPLE

Figure 17A:
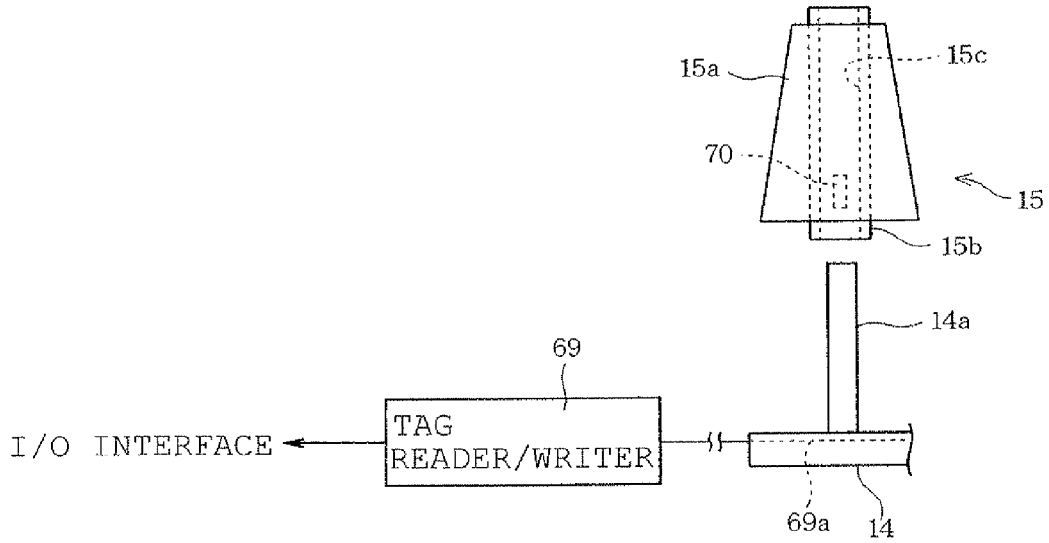
FIGS. 17A and 17B are a frame format of a wireless tag and a tag reader/writer and a block diagram schematically showing an electrical arrangement of the wireless tag, respectively, showing a third example.
Figure 17B:
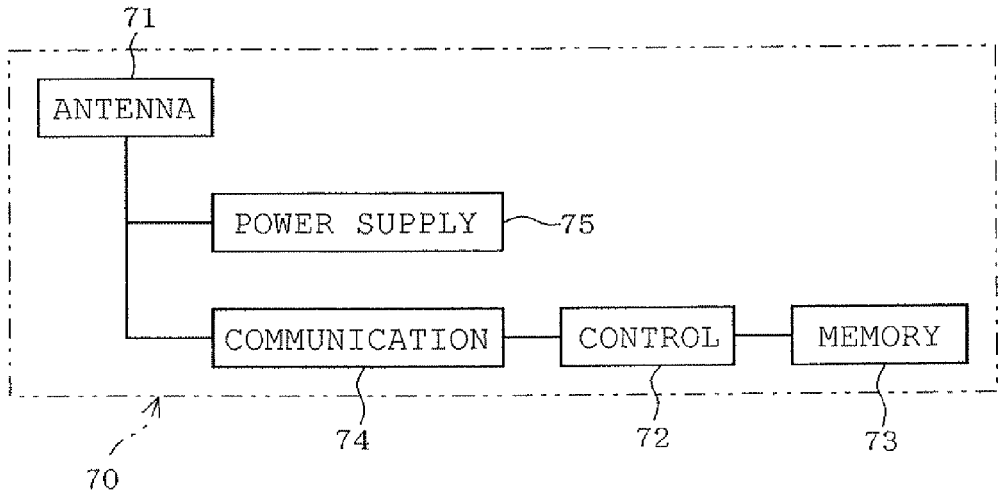

FIGS. 17A and 17B illustrate a third example. The differences between the third embodiment and the first and second embodiments will be described below. The sewing machine M of the third example is provided with tag readers/writers 69, instead of the color detectors 48, as shown in FIG. 17A. The tag readers/writers 69 are electrically connected to the I/O interface 28 and communicate over a radio with wireless tags 70 provided on the thread spools 15 by a non-contact manner, thereby transmitting and receiving information about the thread spools 15, respectively.

The thread spools 15 have cylindrical bobbins 15*b* formed with through holes 15*c* through which spool pins 14*a* are inserted, respectively. Needle threads 15*a* are wound on outer peripheral surfaces of the bobbins 15*b* respectively. The wireless tags 70 are mounted on inner peripheral surfaces of the through holes 15*c* of the bobbins 15*b* respectively. Each wireless tag 70 has a well known configuration and includes an IC chip and small antenna 71. The IC chip has a control 72 as a main component, a memory 73 and a communication 74 the latter two being connected to the control 72. The IC chip 72 also has a power supply 75 which generates a power supply voltage from radio waves received by the antenna 71. The IC chip 72 is operable with the power supply voltage obtained by the power supply 75. When receiving data signals contained in radio waves received by the antenna 71, the communication 74 carries out demodulation of the data signals into original data. The control 72 performs write of contents stored on the memory 73 and the like according to instructions (command) from each tag reader/writer 69. The control 72 also controls the communication 74 according to a command from each tag reader/writer 69 so that data stored on the memory 73 is transmitted. The control 72 also performs control of the communication 74 according to instructions (command) from each tag reader/writer 69 so that data stored on the memory 73 is transmitted. Carrier waves in a predetermined frequency band are modulated by the communication 74 thereby to be transmitted from the antenna 71 to the tag reader/writer 69 side. The data to be transmitted includes thread spool color data stored on the memory 73, that is, thread information such as RGB values of thread colors of the thread spools 15.

On the other hand, the spool holder bases 14 are provided with antennas 69*a* (see FIG. 17A) of the tag readers/writers 69 for the purpose of wireless communication with the tags 70 respectively. The antennas 69*a* are located at positions corresponding to the spool pins 14*a* respectively. The tag readers/writers 69 are configured as reader units which read via the antennas 69*a* of the spool pins 14*a* thread spool color data of all the thread spools 15 set on the spool holder bases 14 respectively.

According to the above-described configuration of the third example, the tag readers/writers 69 is configured to read the thread spool color data of the thread spools 15 set on the spool holder bases 14 from the wireless tags 70 respectively. The control device 6 causes the read thread spool color data to correspond to the respective needle bar numbers, storing the data on the EEPROM 27. This configuration can eliminate the trouble of inputting the thread spool color data and realize easy obtainment of coloration pattern with the use of the thread spools 15 actually set on the spool holder bases 14.

The foregoing examples should not be restrictive but may be modified or expanded as follows. Each spool holder base 14 has only to be configured so that a plurality of thread spools 15 is settable on each spool holder base 14 which is further attachable to the sewing machine M. The number of thread spools 15 may be not less than 11 and not more than 9 according to the number of needle bars or the like. Furthermore, the spool holder bases 14 should not be limited to the paired or right-and-left arrangement but has only to be fixed or attached to the sewing machine M.

The thread spool color storage unit and the full thread color storage unit should not be limited to the EEPROM 27 and the RAM 26. The embroidery data storage unit should not be limited to the ROM 25. These storage units may be other internal storage units built in the sewing machine M or external storage units detachably attachable to the sewing machine M.

The storage medium which stores the embroidery data processing program should not be limited to the ROM 25 of the control device 6 but may be one of a various types of storage media including a CD-ROM, a flexible disc, a DVD and a memory card. In this case, when a computer of the control device in the sewing machine M reads data from the storage medium to execute the read data, the modified form can achieve the same operation and advantageous effects as those of the previous examples.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A multi-needle sewing machine which sews an embroidery pattern based on embroidery data for sewing the embroidery pattern including a plurality of pattern-by-color portions, using a plurality of thread spools, the multi-needle sewing machine comprising:

a spool setting portion on which the thread spools are set;

a spool color storage unit which stores, as thread spool color data, a plurality of thread colors of the thread spools set on the thread spool stand;

an input unit configured to receive one or more user's designations of color for one or more pattern-by-color portions;

an assigning unit that assigns thread color data to each pattern-by-color portion, the assigning unit being configured to:

determine, for each pattern-by-color portion, whether or not the user's designation of the pattern-by-color portion has been received;

when the user's designation for the pattern-by-color portion has been received, assign the user's designation as thread color data for the pattern-by-color portion; and when the user's designation for the pattern-by-color portion has not been received, then randomly extract and assign a non-overlapping color as thread color data for the pattern-by-color portion from the data of the plurality of thread colors stored in the spool color storage unit;

wherein the multi-needle sewing machine is configured to execute sewing of the embroidery pattern for the pattern-by-color portion based on the thread color data assigned by the assigning unit.

2. The machine according to claim 1, further comprising:

an embroidery data storage unit configured to store a plurality of types of the embroidery data;

a pattern selecting unit configured to select a desirable one of the embroidery data stored on the embroidery data storage unit, wherein the thread spool color storage unit stores, as the thread spool color data, the thread color data included in the embroidery data selected by the pattern selecting unit.

3. The machine according to claim 1, further comprising an input unit configured to input thread spool color data of a desirable one of the thread spools, wherein the thread spool color storage unit preferentially stores the thread spool color data input by the input unit.

4. The machine according to claim 1, further comprising:

a full thread color storage unit configured to store thread spool color data of thread spools a number of which is larger than a number of thread spools which can be set on the spool setting portion; and a mode selecting unit which is configured to select either a first mode in which one of the thread spool color data is randomly extracted from the thread spool color storage unit or a second mode in which one of the thread spool data is extracted from the full thread spool color storage unit, regarding the thread spool color data used as the thread color data of the pattern-by-color portion.

5. The machine according to claim 1, further comprising a detection unit configured to detect thread colors of the thread spools set on the spool setting portion, wherein the thread spool color storage unit is configured to store, as the thread spool color data, the thread colors of the thread spools detected by the detection unit.

6. The machine according to claim 1, wherein the thread spools are provided with respective wireless tags each storing the thread spool color data, the machine further comprising a read unit configured to read the thread spool color data from the wireless tags when the thread spools with the respective wireless tags are set on the spool setting portion, wherein the thread spool color storage unit is configured to store the thread spool color data read by the read unit.

7. A non-transitory computer-readable storage medium which is configured to be installed in a multi-needle sewing machine including a spool setting portion on which a plurality of thread spools are set and a thread spool color storage unit storing thread colors of a plurality of thread spools set on the spool setting portion, the medium storing an embroidery data processing program used to generate embroidery data for sewing an embroidery pattern composed of a plurality of pattern-by-color portions by the multi-thread sewing machine, the medium comprising:

a thread spool color storage routine of storing, on the thread spool color storage unit, the thread colors of the thread spools set on the spool setting portion as thread spool color data;

an input routine of receiving a user input to receive one or more user's designations of thread color data of one or more pattern-by-color portions;

an assignment routine of assigning thread color data to each pattern-by-color portion by:

determining, for each pattern-by-color portion, whether or not the user's designation of the pattern-by-color portion has been received;

when the user's designation for the pattern-by-color portion has been received, then the user's designation is assigned as thread color data for the pattern-by-color portion; and if the user's designation for the pattern-by-color portion has not been received, then randomly extract and assign a non-overlapping color as thread color data for the pattern-by-color portion from the data of the plurality of thread colors stored in the spool color storage unit.

8. The medium according to claim 7, wherein the multi-needle sewing machine further includes an embroidery data storage unit configured to store a plurality of types of the embroidery data, and a pattern selecting unit configured to select a desirable one of the embroidery data stored on the embroidery data storage unit; and wherein the embroidery data processing program is configured so that the thread spool color storage unit stores, as the thread spool color data, the thread color data included in the embroidery data selected by the pattern selecting unit in the thread spool color storage routine.

9. The medium according to claim 7, wherein the multi-needle sewing machine further includes an input unit configured to input thread spool color data of a desirable one of the thread spools, and wherein the embroidery data processing program is configured so that the thread spool color storage unit preferentially stores the thread spool color data input by the input unit in the thread spool color storage routine.

10. The medium according to claim 7, wherein the multi-needle sewing machine further includes a full thread color storage unit configured to store thread spool color data of thread spools a number of which is larger than a number of thread spools which can be set on the spool setting portion, and the embroidery data processing program includes a mode selecting routine of selecting either a first mode in which one of the thread spool color data is randomly extracted from the thread spool color storage unit or a second mode in which one of the thread spool data is extracted from the full thread spool color storage unit, regarding the thread spool color data used as the thread color data of the pattern-by-color portion.

11. The medium according to claim 7, wherein the multi-needle sewing machine further includes a detection unit configured to detect thread colors of the thread spools set on the spool setting portion, and wherein the embroidery data processing program is configured to store, as the thread spool color data, the thread colors of the thread spools detected by the detection unit in the thread spool color storage routine.

12. The medium according to claim 7, wherein the thread spools are provided with respective wireless tags each storing the thread spool color data;

the multi-needle sewing machine further includes a read unit configured to read the thread spool color data from the wireless tags when the thread spools with the respective wireless tags are set on the spool holder base; and the embroidery data processing program is configured to store the thread spool color data read by the read unit in the thread spool color storage routine in the thread spool data in the thread spool color storage routine.

* * * * *